US008652716B2

(12) United States Patent
Iwasaki et al.

(10) Patent No.: US 8,652,716 B2
(45) Date of Patent: Feb. 18, 2014

(54) ELECTROPHOTOGRAPHIC PHOTORECEPTOR, IMAGE FORMING APPARATUS, AND PROCESS CARTRIDGE

(75) Inventors: Masahiro Iwasaki, Kanagawa (JP); Jiro Korenaga, Kanagawa (JP); Yuko Yamano, Kanagawa (JP); Yukimi Kawabata, Kanagawa (JP); Daisuke Haruyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 25 days.

(21) Appl. No.: 13/217,947

(22) Filed: Aug. 25, 2011

(65) Prior Publication Data

US 2012/0251932 A1 Oct. 4, 2012

(30) Foreign Application Priority Data

Mar. 28, 2011 (JP) ..... 2011-071185

(51) Int. Cl.
*G03G 15/04* (2006.01)
*G03G 15/02* (2006.01)

(52) U.S. Cl.
USPC ..... 430/66; 430/58.7; 430/69

(58) Field of Classification Search
USPC ..... 430/56, 58.05, 58.7, 58.75, 66, 69
See application file for complete search history.

(56) References Cited

U.S. PATENT DOCUMENTS

| | | | | |
|---|---|---|---|---|
| 5,283,145 | A | 2/1994 | Nukada et al. | |
| 5,298,617 | A | 3/1994 | Nukada et al. | |
| 5,302,479 | A | 4/1994 | Daimon et al. | |
| 5,338,636 | A | 8/1994 | Nukada et al. | |
| 5,358,813 | A | 10/1994 | Iijima et al. | |
| 5,456,989 | A | 10/1995 | Nogami et al. | |
| 5,459,004 | A | 10/1995 | Daimon et al. | |
| 5,654,119 | A | 8/1997 | Ishii et al. | |
| 5,695,898 | A | 12/1997 | Go et al. | |
| 6,180,303 | B1 | 1/2001 | Uematsu et al. | |
| 6,555,279 | B2 | 4/2003 | Nakata et al. | |
| 7,341,814 | B2 | 3/2008 | Kami et al. | |
| 7,887,981 | B2 | 2/2011 | Inagaki et al. | |
| 2001/0031412 | A1* | 10/2001 | Itami et al. | 430/58.15 |
| 2002/0119382 | A1 | 8/2002 | Nakata et al. | |
| 2005/0181291 | A1* | 8/2005 | Kami et al. | 430/66 |
| 2008/0102390 | A1 | 5/2008 | Inagaki et al. | |
| 2009/0238602 | A1 | 9/2009 | Iwasaki et al. | |

FOREIGN PATENT DOCUMENTS

| | | |
|---|---|---|
| EP | 0 710 893 A1 | 5/1996 |
| JP | A-62-251757 | 11/1987 |
| JP | A-04-189873 | 7/1992 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-07-146564 | 6/1995 |
| JP | A-08-176293 | 7/1996 |

(Continued)

*Primary Examiner* — Stewart Fraser
(74) *Attorney, Agent, or Firm* — Oliff & Berridge, PLC

(57) ABSTRACT

Provided is an electrophotographic photoreceptor having a conductive substrate and a photosensitive layer, such that the layer constituting the outermost surface of the photosensitive layer is formed by polymerizing a cross-linkable charge transporting material having a reactive hydroxyl group and a cross-linkable charge transporting material having a reactive alkoxy group, and the ionization potential of the outer surface of the layer constituting the outermost surface is higher by about 0.1 eV or more than the ionization potential of the inner surface of the layer constituting the outermost surface.

15 Claims, 5 Drawing Sheets

(56) References Cited

FOREIGN PATENT DOCUMENTS

| | | |
|---|---|---|
| JP | A-08-208820 | 8/1996 |
| JP | A-2000-019749 | 1/2000 |
| JP | A-2000-066424 | 3/2000 |
| JP | A-2002-082469 | 3/2002 |
| JP | B2-3287678 | 3/2002 |
| JP | A-2005-195961 | 7/2005 |
| JP | A-2005-234546 | 9/2005 |
| JP | A-2006-084711 | 3/2006 |
| JP | A-2008-107729 | 5/2008 |
| JP | B2-4319553 | 6/2009 |
| JP | A-2009-229549 | 10/2009 |

* cited by examiner

ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2011-071185 filed Mar. 28, 2011.

BACKGROUND

1. Technical Field

The present invention relates to an electrophotographic photoreceptor, an image forming apparatus, and a process cartridge.

2. Related Art

In regard to electrophotographic photoreceptors that are used in electrophotographic type image forming apparatuses, photoreceptors provided with a protective layer (surface layer) on the surface have been suggested.

SUMMARY

According to an aspect of the invention, there is provided an electrophotographic photoreceptor including a conductive substrate and a photosensitive layer, wherein the layer constituting the outermost surface of the photosensitive layer is formed by polymerizing a cross-linkable charge transporting material having a reactive hydroxyl group and a cross-linkable charge transporting material having a reactive alkoxy group, and the ionization potential of the outer surface of the layer constituting the outermost surface is higher by about 0.1 eV or more than the ionization potential of the inner surface of the layer constituting the outermost surface.

BRIEF DESCRIPTION OF THE DRAWINGS

Exemplary embodiments of the present invention will be described in detail based on the following figures, wherein.

DETAILED DESCRIPTION

Figure 1:
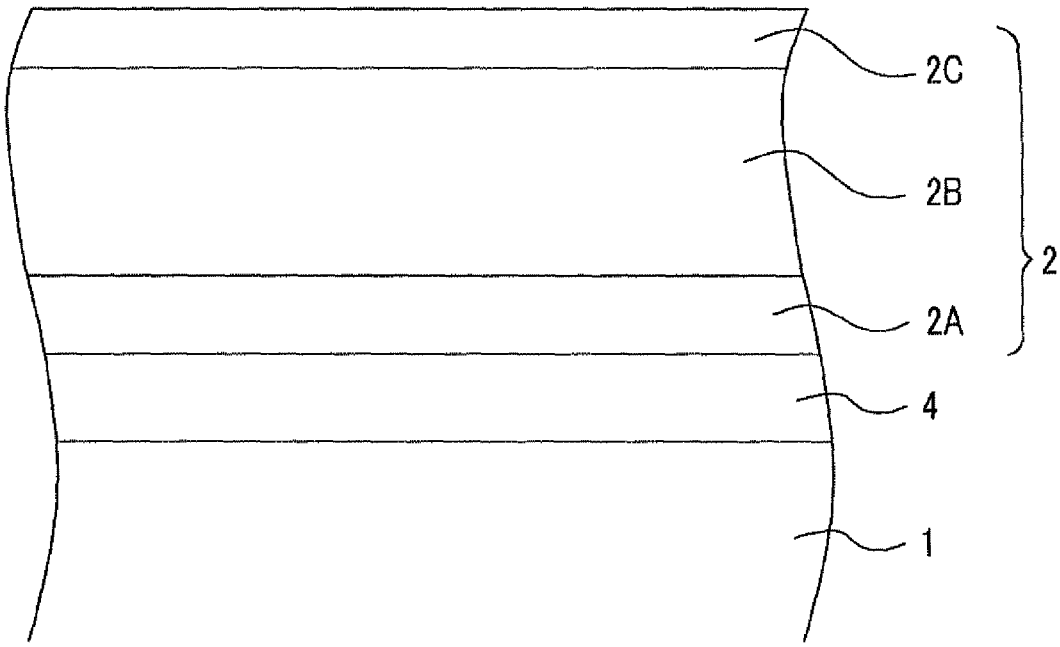
FIG. 1 is a schematic partial cross-sectional view showing an electrophotographic photoreceptor according to a first aspect of an exemplary embodiment of the invention.

Hereinafter, exemplary embodiments of the invention will be described in detail.

<Electrophotographic Photoreceptor>

The electrophotographic photoreceptor according to the exemplary embodiment of the invention has a conductive substrate and a photosensitive layer on the conductive substrate, and the layer constituting the outermost surface of the photosensitive layer (hereinafter, referred to as "surface layer") is formed by polymerizing a cross-linkable charge transporting material having a reactive hydroxyl group and a cross-linkable charge transporting material having a reactive alkoxy group, while the ionization potential of the outer surface of the layer constituting the outermost surface is higher by 0.1 eV or more (or by about 0.1 eV or more) than the ionization potential of the inner surface of the layer constituting the outermost surface.

An electrophotographic photoreceptor used in an electrophotographic type image forming apparatus is required to have resistance to strongly oxidizing gases such as ozone and NOx (oxidation resistance or adhesion resistance), and in the images formed by such an image forming apparatus, suppression of defects in the image quality such as ghost or image deletion is required.

It is found that in the electrophotographic photoreceptor according to the exemplary embodiment of the invention, when the surface layer is formed by mixing a cross-linkable charge transporting material having a reactive hydroxyl group (hereinafter, referred to as "hydroxyl group-containing charge transporting material (A)") and a cross-linkable charge transporting material having a reactive alkoxy group (hereinafter, referred to as "alkoxy group-containing charge transporting material (B)") and polymerizing the mixture, and when the ionization potential of the outer surface of the surface layer of the electrophotographic photoreceptor is higher by 0.1 eV or more than the ionization potential of the inner surface of the surface layer, a balance may be achieved between the resistance to strongly oxidizing gases and the suppression of defects in the image quality.

In regard to the polymerization reaction of a mixture of the hydroxyl group-containing charge transporting material (A) and the alkoxy group-containing charge transporting material (B), it is thought that microphase separation between the hydroxyl group-containing charge transporting material (A) having a hydrophilic hydroxyl group and the alkoxy group-containing charge transporting material (B) having a non-hydrophilic alkoxy group occurs in the initial stage of the reaction.

Furthermore, the polymerization reaction is a complicated combination of three kinds of condensation reactions of a dehydration reaction between the reactive hydroxyl groups of the hydroxyl group-containing charge transporting material (A), a dealcoholization reaction between the reactive alkoxy groups which are terminal groups of the alkoxy group-containing charge transporting material (B) and the hydrogen at the p-position of an aromatic ring of the both charge transporting materials, and a dealcoholization reaction between the reactive hydroxyl group and the reactive alkoxy group, in the presence of an acid catalyst, followed by curing. It is speculated that at this time, a difference in the rate of the curing reaction occurs due to the difference in the activation energy between the reactive hydroxyl group and the reactive alkoxy group, and the hydroxyl group-containing charge transporting material (A) cures faster. As a result, it is speculated that despite the fact that the surface layer obtainable by the polymerization does not seem to have any unevenness in the external appearance, a cured product of the hydroxyl group-containing charge transporting material (A) is localized in the outer side of the surface layer (the opposite side of the conductive substrate), while a cured product of the alkoxy group-containing charge transporting material (B) is localized in the inner side of the surface layer (the conductive substrate side). It is thought that as a result, a difference occurs in the ionization potential between the inner surface and the outer surface of the surface layer. Furthermore, it is contemplated that when the molecules are subjected to structural restraint during the curing process occurring on the outermost surface side, and the resulting cured film has strain, the energy level of the HOMO of the charge transporting material changes, and the value of the ionization potential tends to increase as compared with the uncured surface layer, so that this phenomenon also causes a difference in the ionization potential. It is thought that the sum of these two phenomena leads to the occurrence of a difference of 0.1 eV or greater in the ionization potential between the inner surface and the outer surface of the surface layer.

It is contemplated that when the ionization potential of the outer surface of the surface layer is controlled to be higher by 0.1 eV or more than that of the inner surface, the oxidation resistance of the outer surface of the surface layer may be increased, and thereby the resistance to oxidizing gases such as ozone at the surface layer is enhanced.

Furthermore, although it is advantageous to have a high content of the charge transporting material inside the surface layer from the viewpoint of electrical properties, under certain circumstances, oxidation resistance is decreased as the content of the charge transporting material increases. However, in the electrophotographic photoreceptor according to the exemplary embodiment of the invention, excellent oxidation resistance is obtained even if the proportion of the charge transporting material with respect to the solids content in the surface layer is 90 mass % or greater.

On the other hand, since the ionization potential of the inner surface is lower than that of the outer surface, the barrier to charge injection from an underlying layer of the surface layer (the layer on the conductive substrate side) is less suppressed, and satisfactory charge injection is carried out. As a result, the occurrence of ghost (an afterimage phenomenon occurring due to the history of previous images remaining) or the occurrence of image deletion (an image blurring phenomenon occurring due to a lateral flow of charges as a result of decreased retainability of surface charges) seems to be suppressed.

Furthermore, when a difference occurs in the rate of the curing reaction because of the difference in the activation energy between the hydroxyl group and the alkoxy group as described above, the alkoxy group in the alkoxy group-containing charge transporting material (B) which reacts later than the hydroxyl group-containing charge transporting material (A), also reacts with the hydroxyl group in the hydroxyl group-containing charge transporting material (A), and as a result, the number of unreacted residual hydroxyl groups that remains inside the surface layer is reduced. The unreacted hydroxyl groups remaining in the surface layer form a trap that captures charges or largely affect the environmental changes such as changes in temperature and humidity; however, since the number of residual hydroxyl groups is decreased as described above, it is speculated that the accumulation of residual potential that is generated as a result of the capture of charges by the trap is suppressed, and the environmental stability is also enhanced. Thus, it is thought that the occurrence of image deletion is suppressed.

In addition, it is preferable that the amount of unreacted residual hydroxyl groups that remains inside the surface layer be zero. However, concerning an acceptable value not having any effect on the quality of electrophotographic images, it is preferable that when an infrared (IR) absorption spectrum of the surface layer is measured, the hydroxyl groups be reacted until the percent transmittance (% T) in the stretching vibration peak range of the hydroxyl group (3100 $cm^{-1}$ to 3600 $cm^{-1}$) reaches 95% T or greater. In an IR spectroscopic analysis, the percent transmittance (% T) of the stretching vibration peak range of the hydroxyl group (3100 $cm^{-1}$ to 3600 $cm^{-1}$) is an index representing the number of residual hydroxyl groups, and it is speculated that when this percent transmittance (% T) is in the range described above, the number of unreacted residual hydroxyl groups is decreased.

Furthermore, it is speculated that since the alkoxy group-containing charge transporting material (B) containing alkoxy groups has a lower reaction rate due to the difference in the activation energy between the hydroxyl group and the alkoxy group as described above, the overall reaction rate of the surface layer is consequently slowed. Therefore, it is speculated that the wrinkles of the underlying layer of the surface layer (the layer on the conductive substrate side) that are generated when the curing rate of the surface layer is too fast, are suppressed, and thus an enhancement in adhesiveness due to the segregation effect of the alkoxy group-containing charge transporting material (B) may also be promoted.

Hereinafter, the configuration of the photoreceptor according to the exemplary embodiment of the invention will be described.

—Configuration of Photoreceptor—

The photosensitive layer according to the exemplary embodiment of the invention may have a functionally integrated type photosensitive layer which combines the charge transport ability and the charge generation ability, or may have a functionally separated type photosensitive layer including a charge transport layer and a charge generating layer. Other layers such as an undercoat layer and a protective layer may also be provided.

Hereinafter, the configuration of the photoreceptor according to the exemplary embodiment of the invention will be described with reference to FIG. 1 and FIG. 2, but the present exemplary embodiment is not intended to be limited to FIG. 1 and FIG. 2.

FIG. 1 is a schematic cross-sectional view showing an example of the layer configuration of the photoreceptor according to the exemplary embodiment of the invention, and in FIG. 1, reference numeral 1 represents a conductive substrate, and reference numeral 2 represents a photosensitive layer. Reference numeral 2A represents a charge generating layer, 2B a charge transport layer, and 2C a protective layer. Reference numeral 4 represents an undercoat layer.

The photoreceptor shown in FIG. 1 has a layer configuration in which an undercoat layer 4, a charge generating layer 2A, a charge transport layer 2B, and a protective layer 2C are laminated in this order on a conductive substrate 1, and the photosensitive layer 2 is composed of three layers such as the charge generating layer 2A, the charge transport layer 2B and the protective layer 2C (photoreceptor of first embodiment).

In the photoreceptor shown in FIG. 1, the protective layer 2C is the surface layer constituting the outermost surface.

Figure 2:
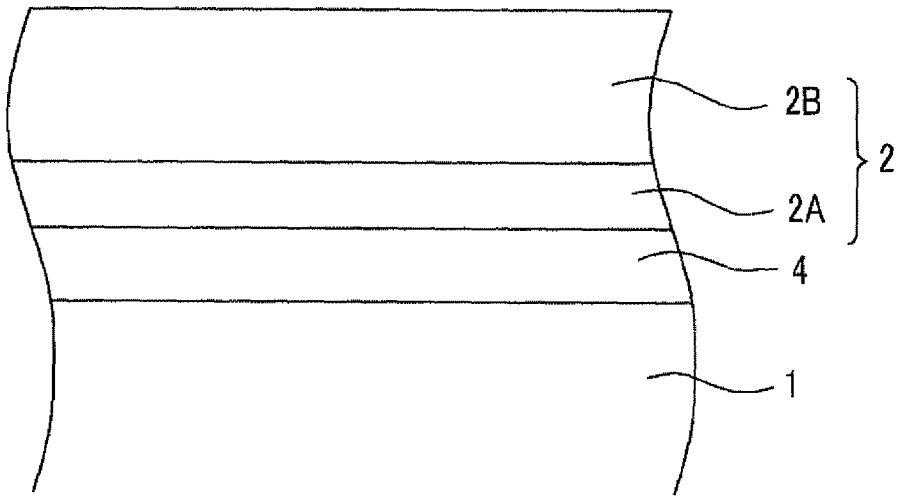
FIG. 2 is a schematic partial cross-sectional view showing an electrophotographic photoreceptor according to a second aspect of the exemplary embodiment of the invention.

FIG. 2 is a schematic cross-sectional view showing another example of the layer configuration of the photoreceptor according to the exemplary embodiment of the invention, and the symbols shown in FIG. 2 have the same meanings as defined in FIG. 1.

The photoreceptor shown in FIG. 2 has a layer configuration in which an undercoat layer 4, a charge generating layer 2A, and a charge transport layer 2B are laminated in this order on a conductive substrate 1, and the photosensitive layer 2 is composed of two layers such as the charge generating layer 2A and the charge transport layer 2B (photoreceptor of a second embodiment).

Here, in the photoreceptor shown in FIG. 2, the charge transport layer 2B is the surface layer constituting the outermost surface.

Furthermore, the embodiment shown in FIG. 1 is an embodiment composed of three layers such as a charge generating layer 2A, a charge transport layer 2B and a protective layer 2C as the photosensitive layer 2 as described above, but in addition to this, the embodiment of the photosensitive layer 2 may be an embodiment having a charge transport layer 2B, a charge generating layer 2A and a protective layer 2C in this order from the conductive substrate 1 side, or may be an embodiment having a functionally integrated type photosensitive layer which combines the charge transport ability and the charge generation ability, and a protective layer 2C.

Hereinafter, the first embodiment and the second embodiment will be respectively described as examples of the photoreceptor according to the exemplary embodiment of the invention.

Photoreceptor of First Embodiment

Surface Layer=Protective Layer

The photoreceptor of the first embodiment has a layer configuration in which an undercoat layer 4, a charge generating layer 2A, a charge transport layer 2B and a protective layer 2C are laminated in this order on a conductive substrate 1, as shown in FIG. 1, and the protective layer 2C is the surface layer.

● Conductive Substrate

As the conductive substrate 1, a conductive substrate having electrical conductivity is used, and examples include a metal plate, a metal drum and a metal belt, which are constructed using a metal such as aluminum, copper, zinc, stainless steel, chromium, nickel, molybdenum, vanadium, indium, gold or platinum, or an alloy; and a paper, a plastic film and a plastic belt, on which an electrically conductive compound such as a conductive polymer or indium oxide, a metal such as aluminum, palladium or gold, or an alloy is applied, deposited or laminated. Here, the "electrical conductivity" implies that the volume resistivity is less than $10^{13}$ Ω·cm.

When the photoreceptor of the first embodiment is used in a laser printer, it is preferable that the surface of the conductive substrate 1 be roughened to have a center line average roughness Ra of from 0.04 μm to 0.5 μm. However, in the case of using incoherent light as the light source, surface roughening need not be carried out in particular.

Preferable examples of the method for surface roughening include wet honing carried out by suspending a polishing agent in water and spraying the suspension onto the support; centerless grinding carried out by bringing the support into contact with a rotating whetstone and continuously performing grinding work; and anodization.

Another example of the method for surface roughening that may also be desirably used is a method of dispersing a conductive or semiconductive powder in a resin to form a layer on the support surface, and roughening the support surface by means of the particles dispersed in the layer, without actually roughening the surface of the conductive substrate 1.

Here, the surface roughening treatment through anodization involves providing an anode made of aluminum and anodizing the anode in an electrolyte solution to thereby form an oxide film on the aluminum surface. Examples of the electrolyte solution include a sulfuric acid solution and an oxalic acid solution. However, since the porous anodized film formed by anodization is chemically active in the state as received, it is desirable to carry out a pore sealing treatment by which the fine pores of the anodized film are blocked through volumetric expansion caused by a hydration reaction in pressurized steam or boiling water (a metal salt of nickel or the like may be added), and the anodized film is converted to more stable hydrated oxide.

The thickness of the anodized film is preferably from 0.3 μm to 15 μm.

Furthermore, the conductive substrate 1 may also be subjected to a treatment using an acidic aqueous solution or a boehmite treatment.

The treatment using an acidic treatment liquid containing phosphoric acid, chromic acid and hydrofluoric acid is carried out as follows. First, an acidic treatment liquid is prepared. The mixing ratios of phosphoric acid, chromic acid and hydrofluoric acid in the acidic treatment liquid are such that the mixing ratio of phosphoric acid is in the range of from 10% by mass to 11% by mass, the mixing ratio of chromic acid is in the range of from 3% by mass to 5% by mass, and the mixing ratio of hydrofluoric acid is in the range of from 0.5% by mass to 2% by mass. The total concentration of these acids is preferably in the range of from 13.5% by mass to 18% by mass. The treatment temperature is preferably from 42° C. to 48° C. The thickness of the coating film is preferably from 0.3 μm to 15 μm.

The boehmite treatment is carried out by immersing the conductive substrate in pure water at a temperature of from 90° C. to 100° C. for from 5 minutes to 60 minutes, or bringing the conductive substrate into contact with heated steam at a temperature of from 90° C. to 120° C. for from 5 minutes to 60 minutes. The thickness of the coating film is preferably from 0.1 to 5 μm. This may be further anodized using an electrolyte solution having lower solubility for the coating film as compared with other kinds such as adipic acid, boric acid, a boric acid salt, a phosphoric acid salt, a phthalic acid salt, a maleic acid salt, a benzoic acid salt, a tartaric acid salt, and a citric acid salt.

● Undercoat Layer

The undercoat layer 4 is, for example, composed of a layer containing inorganic particles in a binder resin.

As the inorganic particles, particles having a powder resistance (volume resistivity) of from $10^2$ Ω·cm to $10^{11}$ Ω·cm are desirably used.

Among them, as the inorganic particles having such a resistance value, it is desirable to use inorganic particles of tin oxide, titanium oxide, zinc oxide, zirconium oxide or the like (electrically conductive metal oxide), and particularly, zinc oxide is desirably used.

Furthermore, the inorganic particles may be subjected to a surface treatment, and mixtures of two or more kinds of inorganic particles having different surface treatments or inorganic particles having different particle sizes may also be used. The volume average particle size of the inorganic particles is desirably in the range of from 50 nm to 2000 nm (preferably, from 60 nm to 1000 nm).

Inorganic particles having a specific surface area according to a BET method of 10 $m^2/g$ or larger are desirably used.

In addition to the inorganic particles, an acceptor compound may also be incorporated. Any acceptor compound may be used, but for example, electron-transporting substances such as quinone-based compounds such as chloranil and bromoanil; tetracyanoquinodimethane-based compounds; fluorenone compounds such as 2,4,7-trinitrofluorenone, and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole; xanthone-based compounds; thiophene compounds; and diphenoquinone compounds such as 3,3',5,5'-tetra-t-butyldiphenoquinone are desirable, and particularly, compounds having an anthraquinone structure are desirable. Furthermore, acceptor compounds having an anthraquinone structure, such as hydroxyanthraquinone-based compounds, aminoanthraquinone-based compounds, aminohydroxyanthraquinone-based compounds are desirably used, and specific examples thereof include anthraquinone, alizarin, quinizarine, anthrarufin, and purpurin.

The content of these acceptor compounds may be set at any value, but desirably, the acceptor compound is incorporated in an amount of from 0.01% by mass to 20% by mass, and more desirably from 0.05% by mass to 10% by mass with respect to the inorganic particles.

The acceptor compound may be added only at the time of applying the undercoat layer 4, or may be adhered in advance to the surfaces of the inorganic particles. Examples of the method of giving an acceptor compound to the surfaces of the inorganic particles include a wet method and a dry method.

When a surface treatment is carried out by a dry method, the inorganic particles are treated by adding dropwise an acceptor compound directly or in the form of a solution in an organic solvent while stirring the inorganic particles with a mixer having a large shear force, and spraying the inorganic particles together with dry air or nitrogen gas. It is desirable to carry out the operation of addition or spraying at a temperature equal to or lower than the boiling point of the solvent. After the addition or spraying, the inorganic particles may also be subjected to firing at 100° C. or above. The firing process may be carried out in any range of conditions of temperature and time.

According to a wet method, the inorganic particles are stirred in a solvent and dispersed using an ultrasonicator, a sand mill, an attritor, a ball null or the like, and an acceptor compound is added to the dispersion. The mixture is stirred or dispersed, and then the solvent is removed. The method for solvent removal is carried out by filtration or distilling off through distillation. After the solvent removal, the inorganic particles may be further subjected to firing at a temperature at or above 100° C. The firing process may be carried out in any range of conditions of temperature and time. In the wet method, the moisture contained in the inorganic particles may be removed before a surface treating agent is added, and for example, use may be made of a method of removing the moisture by stirring and heating the inorganic particles in a solvent that is used in the surface treatment, or a method of removing the moisture by azeotropically boiling with a solvent.

Furthermore, the inorganic particles may be subjected to a surface treatment before the acceptor compound is added. The surface treating agent is selected from known materials. Examples of the surface treating agent include a silane coupling agent, a titanate-based coupling agent, an aluminum-based coupling agent, and a surface active material. Particularly, a silane coupling agent is desirably used. Furthermore, a silane coupling agent having an amino group is desirably used.

Any compound may be used as the silane coupling agent having an amino group, but specific examples include γ-aminopropyltriethoxysilane, N-β-(aminoethyl)-γ-aminopropyltrimethoxysilane, N-β-(aminoethyl)-γ-aminopropylmethyldimethoxysilane, and N,N-bis(β-hydroxyethyl)-β-aminopropyltriethoxysilane, but the examples are not limited to these.

Furthermore, the silane coupling agent may also be used as a mixture of two or more kinds. Examples of a silane coupling agent that may be used in combination with the silane coupling agent having an amino group include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but the examples are not limited to these.

The surface treatment method may be carried out using any known method, but a dry method or a wet method may be used. Furthermore, addition of an acceptor and a surface treatment using a coupling agent may be carried out in combination.

The amount of the silane coupling agent based on the inorganic particles in the undercoat layer 4 is set at any value, but the amount is desirably from 0.5% by mass to 10% by mass with respect to the inorganic particles.

As the binder resin contained in the undercoat layer 4, any known binder resin may be used, but for example, known polymer resin compounds such as an acetal resin such as polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenolic resin, a phenol-formaldehyde resin, a melamine resin, and a urethane resin; charge transporting resins having a charge transporting group; and a conductive resin such as polyaniline, are desirably used. Among them, a resin insoluble in the coating solvent in the upper layer is desirabley used. Particularly, a phenolic resin, a phenol-formaldehyde resin, a melamine resin, a urethane resin, an epoxy resin and the like are desirably used. When these are used in combination of two or more kinds, the mixing ratio is defined according to necessity.

The ratio of the metal oxide imparted with acceptor properties and the binder resin in the coating liquid for undercoat layer formation, or the ratio of the inorganic particles and the binder resin is arbitrarily set.

Various additives may also be used in the undercoat layer 4. Examples of the additives include known materials such as electron transporting pigments such as polycyclic condensed ring-based pigments and azo-based pigments; zirconium chelate compounds, titanium chelate compounds, aluminum chelate compounds, titanium alkoxide compounds, organotitanium compounds, and silane coupling agents. The silane coupling agent is used in the surface treatment of the metal oxide, but the silane coupling agent may also be used in the coating liquid as an additive. Specific examples of the silane coupling agent used herein include vinyltrimethoxysilane, γ-methacryloxypropyltris(β-methoxyethoxy)silane, β-(3,4-epoxycyclohexyl)ethyltrimethoxysilane, γ-glicycloxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compounds include zirconium butoxide, ethyl zirconium acetoacetate, zirconium triethanolamine, acetylacetonate zirconium butoxide, ethyl acetoacetate, zirconium butoxide, zirconium acetate, zirconium oxalate, zirconium lactate, zirconium phosphonate, zirconium octanoate, zirconium naphthenate, zirconium laurate zirconium stearate, zirconium isostearate, methacrylate zirconium butoxide, stearate zirconium butoxide and isostearate zirconium butoxide.

Examples of the titanium chelate compounds include tetraisopropyl titanate, tetra-n-butyl titanate, butyl titanate diner, tetra(2-ethylhexyl)titanate, titanium acetylacetonate, polytitanium acetylacetonate, titanium octylene glycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butylate, ethylacetoacetate aluminum diisopropylate, and aluminum tris(ethyl acetoacetate).

These compounds may be used alone, or as a mixture or a polycondensate of plural compounds.

The solvent for preparing the coating solution for undercoating layer formation may be appropriately selected from known organic solvents such as alcohol solvents, aromatic solvents, halogenated hydrocarbon solvents, ketone solvents, ketone alcohol solvents, ether solvents, and ester solvents. Examples of the solvent include conventional organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for such dispersion may be used alone or as a mixture of two or more kinds. As the solvent used for mixing, any solvent capable of dissolving a binder resin while being in the form of a mixed solvent, may be used.

As a method for dispersion, any known method of using a roll mill, a ball mill, a vibration ball mill, an attritor, a sand mill, a colloid mill and a paint shaker is used. Furthermore, as a coating method used for providing this undercoat layer 4, any of conventional methods such as a blade coating method, a wire bar coating method, a spray coating method, a dipping coating method, a bead coating method, an air knife coating method and a curtain coating method is used.

The coating liquid for undercoat layer formation thus obtained is used to form the undercoat layer 4 on the conductive substrate 1.

Furthermore, the undercoat layer 4 desirably has a Vickers hardness of 35 or greater.

Also, the undercoat layer 4 may have any thickness, but it is desirable that the undercoat layer 4 have a thickness of 15 μm or grater, and more desirably from 15 μm to 50 μm.

In order to prevent Moiré patterns, the surface roughness (ten-point average roughness) of the undercoat layer 4 is adjusted to a value between ¼n (n represents the refractive index of the upper layer) of the wavelength λ of the exposure laser used, and ½λ. In order to adjust the surface roughness, particles of a resin or the like may also be added to the undercoat layer. Examples of resin particles that may be used include silicone resin particles, and cross-linked type polymethyl methacrylate resin particles.

The undercoat layer 4 desirably contains a binder resin and an electrically conductive metal oxide, and has a light transmittance of 40% or less (more desirably, from 10% to 35%, and even more desirably, from 15% to 30%) with respect to a light having a wavelength of 950 nm at a layer thickness of 20 μm.

The light transmittance of the undercoat layer is measured as described below. A coating liquid for undercoat layer formation is applied on a glass plate so as to obtain a thickness after drying of 20 μm, and after drying, the light transmittance of the film at a wavelength of 950 nm is measured using a spectrophotometer. The light transmittance based on spectrophotometry is measured using "Spectrophotometer (U-2000): manufactured by Hitachi, Ltd." as the spectrophotometer.

The light transmittance of this undercoat layer may be controlled by adjusting the dispersion time at the time of dispersing using a roll mill, a ball mill, a vibration ball mill, an attritor, a sand mill, a colloid mill, a paint shaker or the like as described above. The dispersion time is not particularly limited, but a time period of from 5 minutes to 1000 hours is desirable, and more desirably from 30 minutes to 10 hours. If the dispersion time is lengthened, the light transmittance tends to be decreased.

The undercoat layer may be polished for the adjustment of the surface roughness. Methods for polishing that may be used include buffing, sandblast treatment, wet honing, grinding treatment, and the like.

The undercoat layer is obtained by drying the applied coating, and the drying process is usually carried out at a temperature at which a film may be formed by evaporating the solvent.

● Charge Generating Layer

The charge generating layer 2A is desirably a layer containing at least a charge generating material and a binder resin.

Examples of the charge generating material include azo pigments such as bisazo and trisazo, condensed-ring aromatic pigments such as dibromoanthanthrone, perylene pigments, pyrrolopyrrole pigments, phthalocyanine pigments, zinc oxide, and trigonal selenium. Among these, for the exposure with a laser light in the near-infrared region, metallic and/or metal-free phthalocyanine pigments are desirable, and particularly, hydroxygallium phthalocyanines disclosed in JP1993-263007A(JP-H05-263007A) and JP1993-279591A (JP-H05-279591A); chlorogallium phthalocyanines disclosed in JP1993-098181A(JP-H05-098181A); dichlorotin phthalocyanines disclosed in JP1993-140472A(JP-H05-140472A) and JP1993-140473A(JP-H05-140473A); and titanyl phthalocyanines disclosed in JP1992-189873A(JP-H04-189873A) and JP1993-142802A(JP-H05-142802A) are more desirable. For the exposure with a laser light in the near-ultraviolet region, condensed-ring aromatic pigment such as dibromoanthanthrone, thioindigo pigment, porphyrazine compound, zinc oxide, trigonal selenium and the like are more desirable. As the charge generating material, in the case of using a light source having an exposure wavelength of from 380 nm to 500 nm, inorganic pigments are desirable, and in the case of using a light source having an exposure wavelength of from 700 nm to 800 nm, metallic and metal-free phthalocyanines are desirable.

As the charge generating material, it is desirable to use a hydroxygallium phthalocyanine pigment having a maximum peak wavelength in the range of from 810 nm to 839 nm in the spectroscopic absorption spectrum in the wavelength region of from 600 nm to 900 nm. This hydroxygallium phthalocyanine pigment is different from the conventional V-type hydroxygallium phthalocyanine pigments, and is a pigment for which the maximum peak wavelength of the spectroscopic absorption spectrum has been shifted to the shorter wavelength side than the maximum peak wavelength of the conventional V-type hydroxygallium phthalocyanine pigments.

Furthermore, as the hydroxygallium phthalocyanine pigments having a maximum peak wavelength in the range of from 810 nm to 839 nm, a hydroxygallium phthalocyanine pigment having an average particle size in a specific range and having a BET specific surface area in a specific range is desirable. Specifically, it is desirable that the hydroxygallium phthalocyanine pigment have an average particle size of 0.20 μm or less, and more desirably from 0.01 mm to 0.15 μm, and have a BET specific surface area of 45 $m^2/g$ or larger, more desirably 50 $m^2/g$ or larger, and particularly desirably from 55 $m^2/g$ to 120 $m^2/g$. The average particle size is the volume average particle size (d50 average particle size), and is a value measured using a laser diffraction-scattering type particle size distribution analyzer (LA-700, manufactured by Horiba, Ltd.). Furthermore, the BET type specific surface area is a value measured by a nitrogen adsorption method using a BET type specific surface area analyzer (FLOW SORB II2300; manufactured by Shimadzu Corp.).

Furthermore, the maximum particle size (maximum value of primary particle size) of the hydroxygallium phthalocyanine pigment is desirably 1.2 μm or less, more desirably 1.0 μm or less, and even more desirably 0.3 μm or less.

The hydroxygallium phthalocyanine pigment desirably has an average particle size of 0.2 μm or less, a maximum particle size of 1.2 μm or less, and a specific surface area value of 45 $m^2/g$ or larger.

The hydroxygallium phthalocyanine pigment desirably has diffraction peaks at Bragg's angles)(2θ±0.2° of 7.5°, 9.9°, 12.5°, 16.3°, 18.6°, 25.1° and 28.3° in the X-ray diffraction spectrum obtained by using CuKα characteristic X-rays.

The hydroxygallium phthalocyanine pigment desirably has a thermal weight reduction resulting from a temperature increase from 25° C. to 400° C., of from 2.0% to 4.0%, and more desirably from 2.5% to 3.8%.

The binder resin used in the charge generating layer 2A is selected from a wide variety of insulating resins, and may also be selected from organic photoconductive polymers such as poly-N-vinylcarbazole, polyvinylanthracene, polyvinylpyrene, and polysilanes. Desirable examples of the binder resin include a polyvinyl butyral resin, a polyallylate resin (a polycondensate of a bisphenol and an aromatic divalent carboxylic acid, or the like), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. These binder resins are used individually, or as mixtures of two or more kinds. The mixing ratio of the charge generating material and the binder resin is desirably in the range of from 10:1 to 1:10 on a mass basis. Here, the term "insulating" means that the volume resistivity is $10^{13}$ Ω·cm or greater.

The charge generating layer 2A is formed by, for example, using a coating liquid in which the charge generating material and the binder resin are dispersed in a solvent.

Examples of the solvent used in dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used individually or as mixtures of two or more kinds.

As the method of dispersing the charge generating material and the binder resin in a solvent, a conventional method such as a ball mill dispersion method, an attritor dispersion method, or a sand mill dispersion method, is used. Furthermore, during this dispersion, it is effective to adjust the average particle size of the charge generating material to 0.5 μm or less, desirably 0.3 μm or less, and more desirably 0.15 μm or less.

Furthermore, in order to form a charge generating layer 2A, a conventional method such as a blade coating method, a wire bar coating method, a spray coating method, a dipping coating method, a bead coating method, an air knife coating method or a curtain coating method, is used.

The thickness of the charge generating layer 2A thus obtained is desirably from 0.1 μm to 5.0 μm, and more desirably from 0.2 μm to 2.0 μm.

● Charge Transport Layer

The charge transport layer 2B is desirably a layer containing at least a charge transporting material and a binder resin, or a layer containing a polymer charge transporting material.

Examples of the charge transporting material include electron transporting compounds such as quinone compounds such as p-benzoquinone, chloranil, bromanil and anthraquinone, tetracyanoquinodimethane compounds, fluorenone compounds such as 2,4,7-trinitrofluorenone, xanthone compounds, benzophenone compounds, cyanovinyl compounds, and ethylene compounds; and hole transporting compounds such as triarylamine compounds, benzidine compounds, arylalkane compounds, aryl-substituted ethylene compounds, stilbene compounds, anthracene compounds, and hydrazone compounds. These charge transporting materials are used individually or as mixtures of two or more kinds, but the examples are not limited to these.

The charge transporting material is desirably a triarylamine derivative represented by the following structural formula (a-1), or a benzidine derivative represented by the following structural formula (a-2), from the viewpoint of charge mobility.

(a-1)

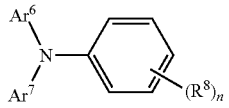

In the structural formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)—C(R^{10})(R^{11})$, or $—C_6H_4—CH=CH—CH=C(R^{12})(R^{13})$; $R^9$ to $R^{13}$ each independently represent a hydrogen atom, a substituted or unsubstituted alkyl group, or a substituted or unsubstituted aryl group; and examples of the substituent include a halogen atom, an alkyl group having 1 to 5 carbon atoms, an alkoxy group having 1 to 5 carbon atoms, and an amino group substituted with an alkyl group having 1 to 3 carbon atoms.

(a-2)

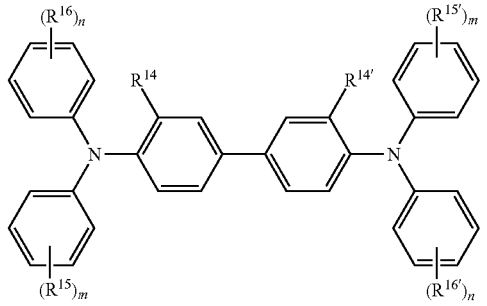

In the structural formula (a-2), $R^{14}$ and $R^{14'}$ may be identical or different, and each independently represents a hydrogen atom, a halogen atom, an alkyl group having 1 to 5 carbon atoms, or an alkoxy group having 1 to 5 carbon atoms; $R^{15}$, $R^{15'}$, $R^{16}$ and $R^{16'}$ may be identical or different, and each independently represents a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{17})=C(R^{18})(R^{19})$, or $—CH=CH—CH=C(R^{20})(R^{21})$; $R^{17}$ to $R^{21}$ each independently represent a hydrogen atom, a substituted or unsubstituted alkyl group, or a substituted or unsubstituted aryl group; and m and n each independently represent an integer from 0 to 2.

Here, among the triarylamine derivatives represented by the structural formula (a-1) and the benzidine derivatives represented by the structural formula (a-2), particularly a triarylamine derivative having "$—C_6H_4—CH=CH—CH=C(R^{12})(R^{13})$" and a benzidine derivative having "$—CH=CH—CH=C(R^{20})(R^{21})$" are desirable.

Examples of the binder resin used in the charge transport layer 2B include a polycarbonate resin, a polyester resin, a polyallylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, and polysilane. Also, as described above, polymer charge transporting materials such as the polyester-based polymer charge transporting materials disclosed in JP1996-176293A (JP-H08-176293A) and JP1996-208820A (JP-H08-208820A) may also be used. These binder resins are used individually or as mixtures of two or more kinds. The mixing ratio of the charge transporting material and the binder resin is desirably from 10:1 to 1:5 on a mass basis.

The binder resin is not particularly limited, but at least one of a polycarbonate resin having a viscosity average molecular weight of from 50,000 to 80,000, and a polyallylate resin having a viscosity average molecular weight of from 50,000 to 80,000 is desirable.

A polymer charge transporting material may also be used as the charge transporting material. As the polymer charge transporting material, known polymers having charge transportability, such as poly-N-vinylcarbazole and polysilane are used. Especially, the polyester-based polymer charge transporting materials disclosed in JP1996-176293A (JP-H08-176293A), JP1996-208820A (JP-H08-208820A) and the like are particularly desirable. The polymer charge transporting material is capable of forming a film only by itself, but the polymer charge transporting material may be mixed with a binder resin that will be described later and used in film formation.

The charge transport layer 2B is formed by, for example, using a coating liquid for charge transport layer formation containing the constituent materials described above. As the solvent used in the coating liquid for charge transport layer formation, conventional organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; cyclic or linear ethers such as tetrahydrofuran, and ethyl ether, are used individually or as mixtures of two or more kinds. As the method of dispersing the various constituent materials, any known method is used.

As the method of coating used when the coating liquid for charge transport layer formation is applied on the charge generating layer 2A, a conventional method such as a blade coating method, a wire bar coating method, a spray coating method, a dipping coating method, a bead coating method, an air knife coating method, or a curtain coating method is used.

The thickness of the charge transport layer 2B is desirably from 5 μm to 50 μm, and more desirably from 10 μm to 30 μm.

● Protective Layer (Ionization Potential)

The protective layer 2C is a surface layer in the photoreceptor of the first embodiment. The protective layer 2C which serves as the surface layer in the photoreceptor of the first embodiment is such that the ionization potential of the outer surface is higher by 0.1 eV or more (or by about 0.1 eV or more) as compared with the ionization potential of the inner surface, as described above. Furthermore, the ionization potential of the outer surface is more desirably higher by 0.15 eV or more (or by about 0.15 eV or more). Although not particularly limited, the upper limit of the difference of the ionization potential is desirably 0.3 eV or less (or about 0.3 eV or less).

The absolute values of the ionization potentials of the inner surface and the outer surface in the surface layer (protective layer 2C in the first embodiment) are desirably such that the ionization potential of the inner surface is from 5.2 eV to 5.7 eV, and more desirably from 5.3 eV to 5.6 eV. The ionization potential of the outer surface is desirably from 5.5 eV to 5.9 eV, and more desirably from 5.6 eV to 5.8 eV.

Here, the ionization potentials of the outer surface and the inner surface in the protective layer are controlled by the selection of the materials used as the hydroxyl group-containing charge transporting material (A) and the alkoxy group-containing charge transporting material (B), and the curing temperature of the protective layer, and the protective layer is formed with a combination of materials and under the reaction conditions which result in a difference in the ionization potential of 0.1 eV or greater.

The ionization potential is measured as described below. A coating liquid for protective layer formation is applied as a single layer on an aluminum substrate, and the coating liquid is dried and cured. Subsequently, the cured film thus obtained is peeled off, and the surface of the cured film is washed with a cloth soaked with methanol. Subsequently, the ionization potentials of the outer surface and the inner surface are measured using AC-2 manufactured by Riken Keiki Co., Ltd.

(Percent Transmittance)

The amount of unreacted residual hydroxyl groups that remains behind in the protective layer 2C is desirably zero. However, concerning the value of the amount that is acceptable without any influence on the image quality of electrophotographs, it is desirable to allow the hydroxyl groups to react until the percent transmittance (% T) of the hydroxyl group in the stretching vibration peak range (3100 $cm^{-1}$ to 3600 $cm^{-1}$) reaches 95% T or greater (or about 95% T or greater) when the infrared absorption spectrum of the surface layer is measured.

It is more desirable that the percent light transmittance (percent transmittance of the vibration absorption peaks of the hydroxyl group: % T) of the surface layer be 97% T or greater.

The percent transmittance (% T) of the hydroxyl group in the stretching vibration peak range (3100 $cm^{-1}$ to 3600 $cm^{-1}$) in an IR spectroscopic analysis is an index representing the number of residual hydroxyl groups, and it is speculated that when this percent transmittance (% T) is in the range described above, the number of unreacted residual hydroxyl groups is reduced.

The percent light transmittance of the surface layer (percent transmittance of the vibration absorption peaks of the hydroxyl group: % T) is measured as follows. A coating liquid for surface layer formation is applied as a single layer on an aluminum substrate, or after a photosensitive layer is laminated on an aluminum substrate, and the coating liquid is dried and cured. Subsequently, the transmittance of the cured film thus obtained is measured according to an ATR method using an FT/IR-6100 manufactured by JASCO Corp. in the wavenumber range of 400 $cm^{-1}$ to 4000 $cm^{-1}$, and this transmittance is multiplied by 100 to determine the percent transmittance (% T). Here, the percent transmittance (% T) based on the hydroxyl group is determined such that the offset portion having no absorption is subjected to baseline correction, and the lowest value in the wavenumber region of 3100 $cm^{-1}$ to 3600 $cm^{-1}$ is designated as the transmittance.

(Charge Transporting Material)

In the surface layer (protective layer 2C in the first embodiment), a cross-linkable charge transporting material having a reactive hydroxyl group (hydroxyl group-containing charge transporting material (A)) and a cross-linkable charge transporting material having a reactive alkoxy group (alkoxy group-containing charge transporting material (B)) are used as the charge transporting materials.

The surface layer (protective layer 2C) is desirably formed by performing polymerization using the hydroxyl group-containing charge transporting material (A) and the alkoxy group-containing charge transporting material (B) in an amount of 90% by mass or more (or about 90% by mass or more), and more desirably 94% by mass or more, based on the total amount of the monomers constituting the solids content. The upper limit of this amount is not limited as long as the guanamine compound that will be described later or additives such as an antioxidant and a curing catalyst function effectively, and it is more desirable to have a larger amount of the charge transporting materials.

The hydroxyl group-containing charge transporting material (A) is particularly desirably a compound represented by the following formula (I-1), and the alkoxy group-containing charge transporting material (B) is particularly desirably a compound represented by the following formula (I-2).

$$F^1\text{-}(L^1\text{-}OH)_n \quad \text{(I-1)}$$

$$F^2\text{-}(L^2\text{-}OR)_m \quad \text{(I-2)}$$

wherein in the formula (I-1) and formula (I-2), $F^1$ and $F^2$ each independently represent an organic group derived from a compound having hole transportability; $L^1$ and $L^2$ each independently represent a single bond, or a linear or branched alkylene group having 1 to 5 carbon atoms; R represents an alkyl group; and n and m each independently represent an integer from 1 to 4.

In the formulas (I-1) and (I-2), it is suitable that the number of substituents, n and m, be each independently 2 or greater.

In the formulas (I-1) and (I-2), the compound having hole transport ability for the organic group derived from a compound having hole transport ability represented by $F^1$ and $F^2$, is suitably an arylamine derivative. Suitable examples of the arylamine derivative include a triphenylamine derivative and a tetraphenylbenzidine derivative.

The compounds represented by formula (I-1) and formula (I-2) may be desirably a compound having the structure represented by the following formula (II).

(II)

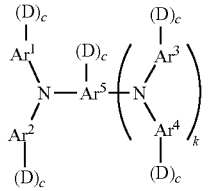

In the formula (II), $Ar^1$ to $Ar^4$ may be identical or different, and each independently represents a substituted or unsubstituted aryl group; $Ar^5$ represents a substituted or unsubstituted aryl group or a substituted or unsubstituted arylene group; D represents -($L^1$-OH) or -($L^2$-OR); c's each independently represent 0 or 1; k represents 0 or 1; and the total number of D's is from 1 to 4, while $L^1$ and $L^2$ each independently represent a single bond, or a linear or branched alkylene group having from 1 to 5 carbon atoms; and R represents an alkyl group.

The total number of D's in the formula (II) is equivalent to n or m in the formulas (I-1) and (I-2), and the total number is desirably from 2 to 4, and more desirably from 3 to 4. That is, it is desirable that the formulas (I-1) and (I-2) or formula (II) have desirably from two to four, and more desirably from three to four, reactive functional groups (that is, —OH or —OR) in one molecule.

In the formula (II), $Ar^1$ to $Ar^4$ are each desirably any one of the following formula (1) to formula (7). Furthermore, the following formula (1) to formula (7) are collectively represented by "-$(D)_c$" that may be linked to $Ar^1$ to $Ar^4$, respectively.

(1)

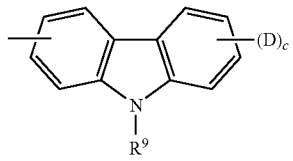

(2)

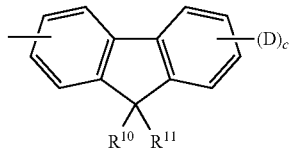

(3)

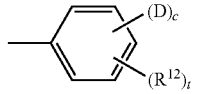

(4)

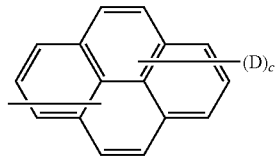

(5)

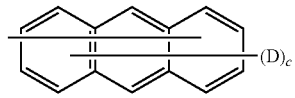

-continued (6)

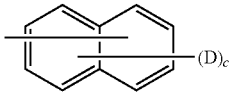

(7)

In the formulas (1) to (7), $R^9$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^{10}$ to $R^{12}$ each represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D and c have the same definitions as "D" and "c", respectively, in the formula (II); s's each represent 0 or 1; and t represents an integer from 1 to 3.

Here, Ar in the formula (7) is desirably represented by the following formula (8) or (9).

(8)

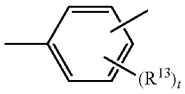

(9)

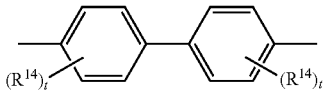

In the formulas (8) and (9), $R^{13}$ and $R^{14}$ each represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and t represents an integer from 1 to 3.

Furthermore, Z' in the formula (7) is desirably represented by any one of the following formulas (10) to (17).

(10)

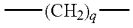

(11)

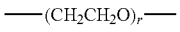

(12)

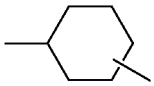

(13)

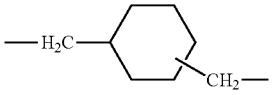

(14)

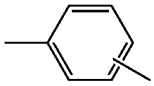

-continued (15)

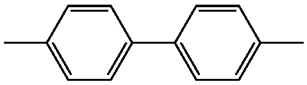

(16)

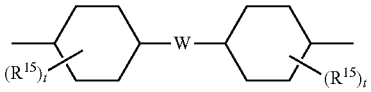

(17)

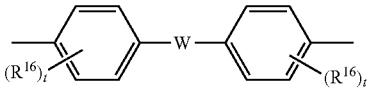

In the formulas (10) to (17), $R^{15}$ and $R^{16}$ each represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; q and r each represent an integer from 1 to 10; and is each represent an integer from 1 to 3.

W in the formulas (16) and (17) is desirably any one of the divalent groups represented by the following formulas (18) to (26). However, in the formula (25), u represents an integer from 0 to 3.

(18)

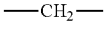

(19)

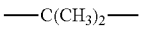

(20)

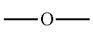

(21)

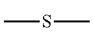

(22)

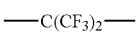

(23)

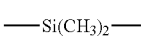

(24)

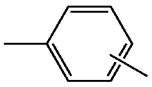

(25)

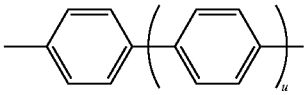

(26)

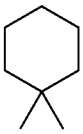

Furthermore, in the formula (II), $Ar^5$ is desirably an aryl group of any one of the formulas (1) to (7) exemplified in the definitions for $Ar^1$ to $Ar^4$ when k is 0, and is desirably an arylene group from which one hydrogen atom is eliminated from any one of such aryl groups of the formulas (1) to (7) when k is 1.

In the formulas (I-1) and (I-2), the organic group derived from the compound having hole transport ability represented by $F^1$ and $F^2$, is particularly desirably a triphenylamine skeleton, an N,N,N',N'-tetraphenylbenzidine skeleton, a stilbene skeleton, or a hydrazone skeleton, and among them, a triphenylamine skeleton or an N,N,N',N'-tetraphenylbenzidine skeleton is preferable.

These organic groups may have substituents, and examples of the substituent include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, or a halogen atom, and among them, an alkyl group having 1 to 4 carbon atoms or an alkoxy group having 1 to 4 carbon atoms is preferable.

The linear or branched alkylene group having 1 to 5 carbon atoms represented by $L^1$ and $L^2$ is particularly preferably a methylene group, an ethylene group or —$CH(CH_3)$—, and among them, a methylene group is preferable.

The alkyl group represented by R is particularly preferably a methyl group, an ethyl group, a propyl group or an isopropyl group, and among them, a methyl group is preferable.

Here, specific examples of the compound represented by the formula (I-1) include the following compounds, but are not limited to these.

I-1

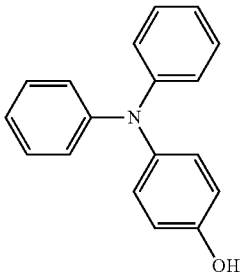

I-2

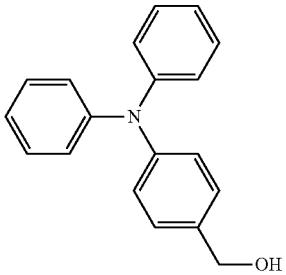

I-3

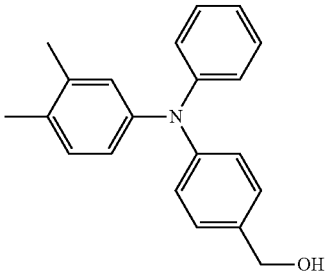

-continued

I-4

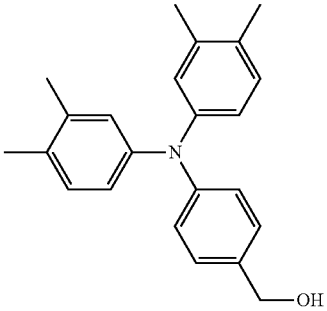

I-5

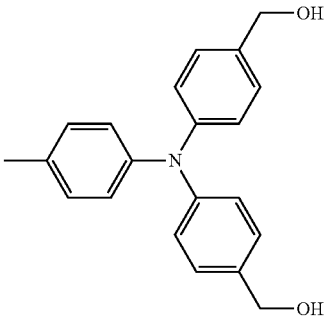

I-6

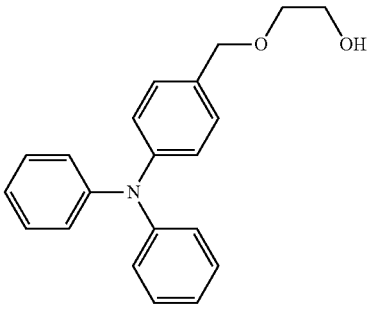

I-7

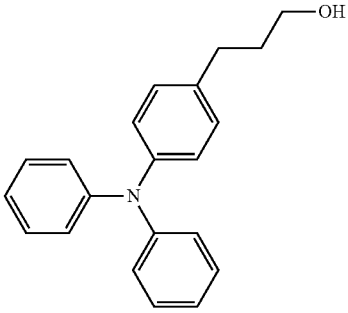

I-8

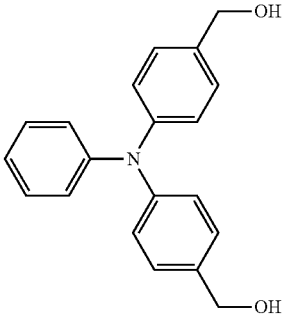

-continued
I-9
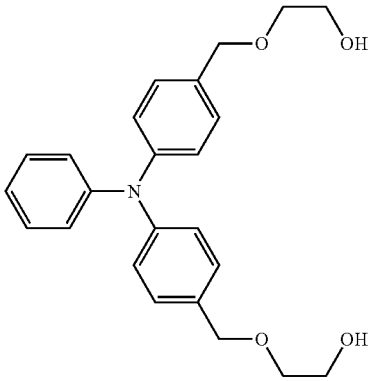
I-10
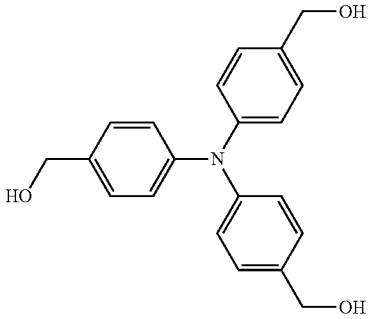
I-11
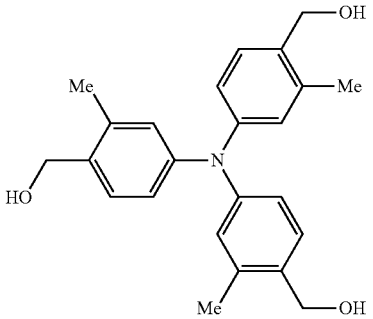
I-12
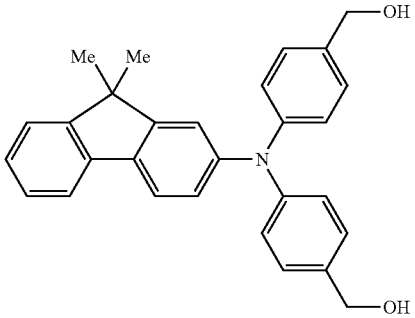
-continued
I-13
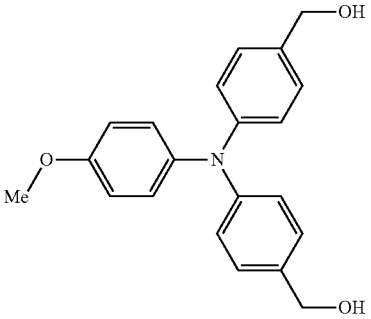
I-14
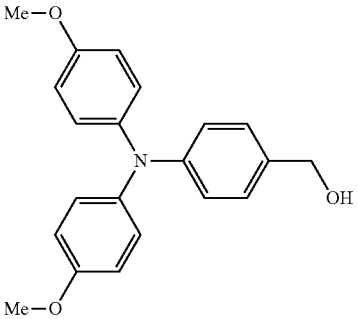
I-15
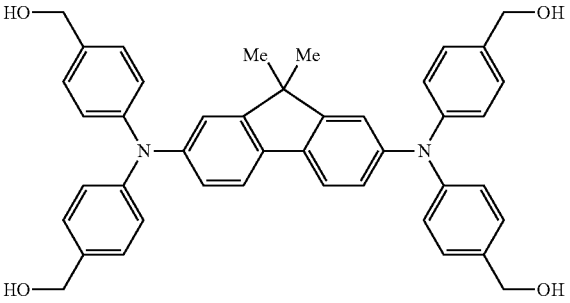
I-16
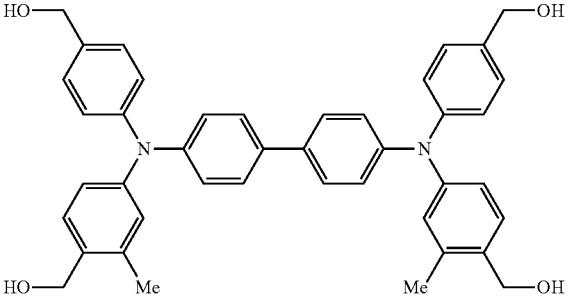
I-17
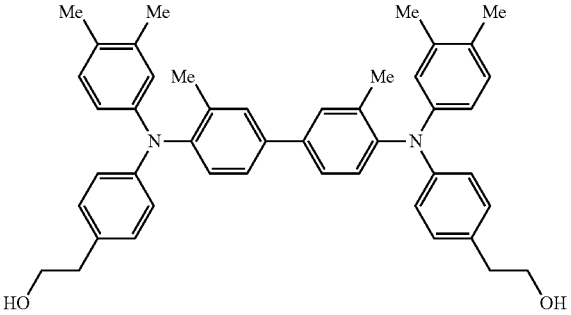

-continued
I-18
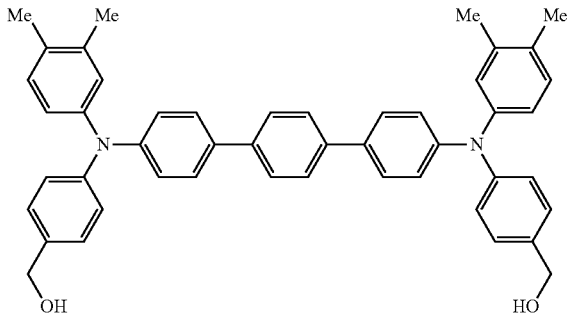
I-19
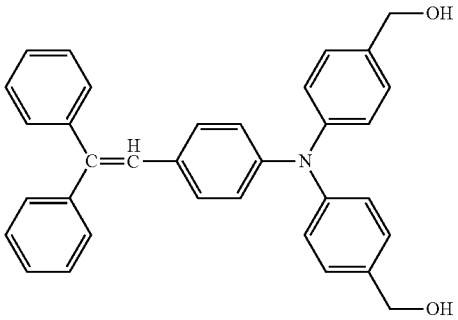
I-20
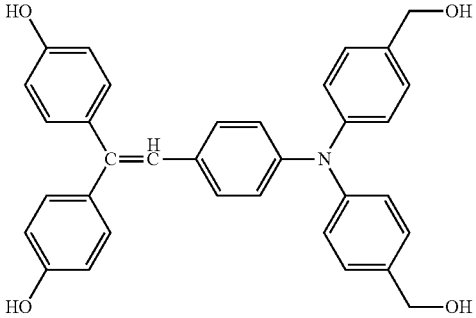
I-21
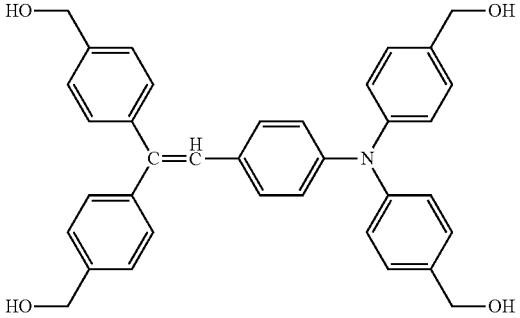
-continued
I-22
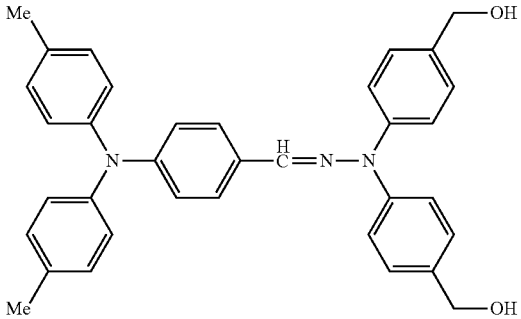
I-23
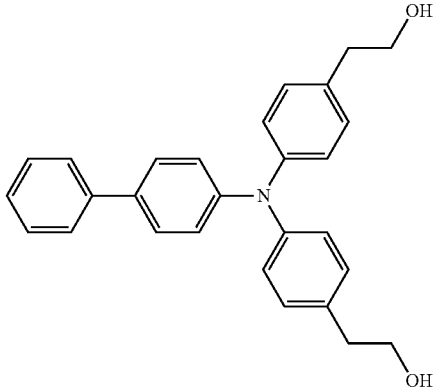
I-24
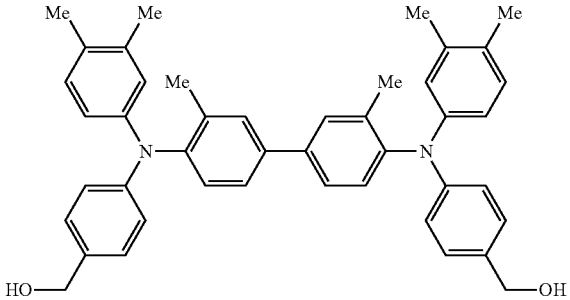
I-25
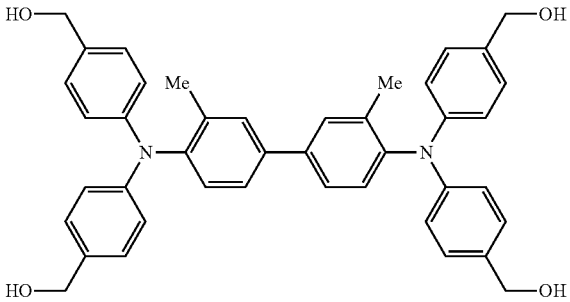
Here, specific examples of the compound represented by the formula (I-2) include the following compounds, but are not limited to these.

I-26
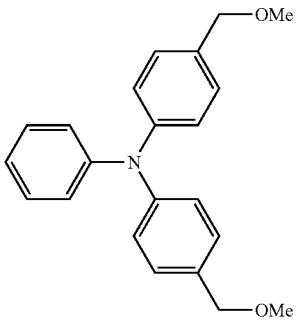
I-27
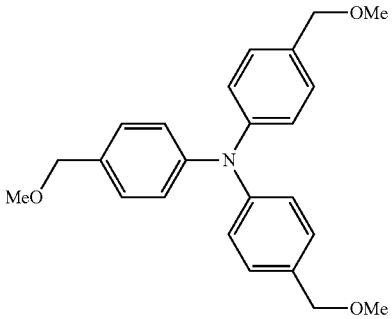
I-28
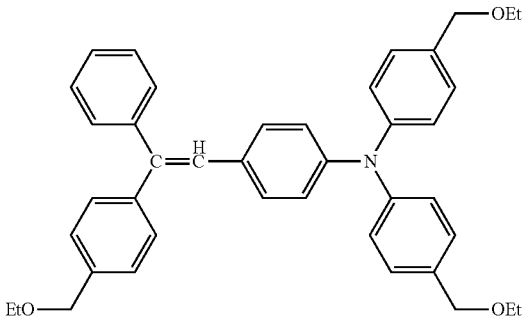
I-29
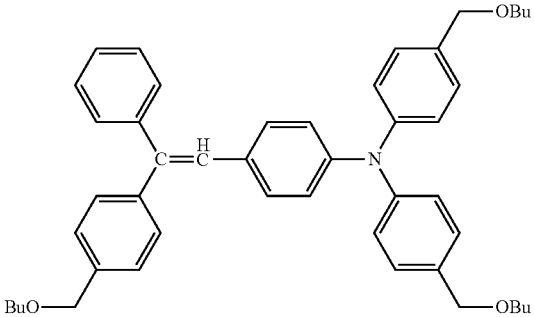
-continued
I-30
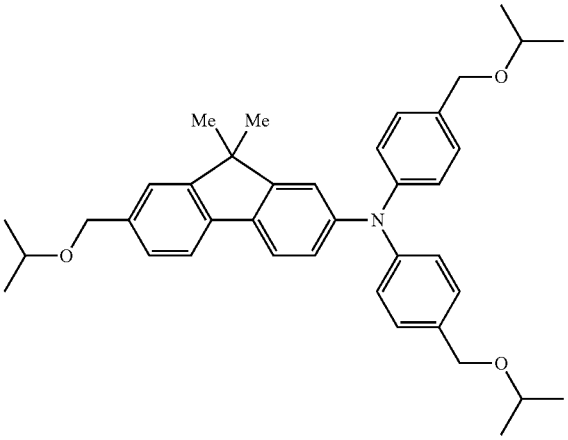
I-31
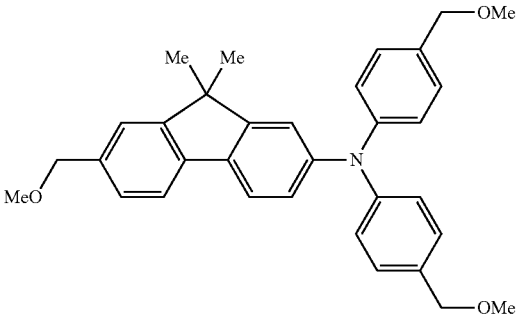
I-32
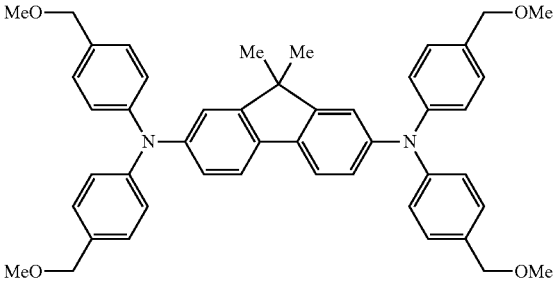
I-33
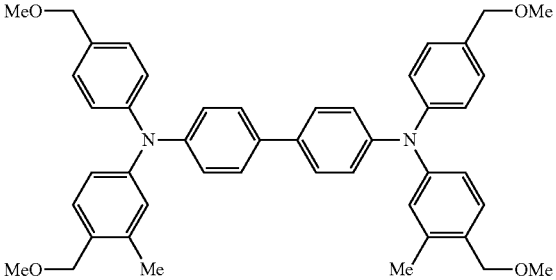

-continued

I-34

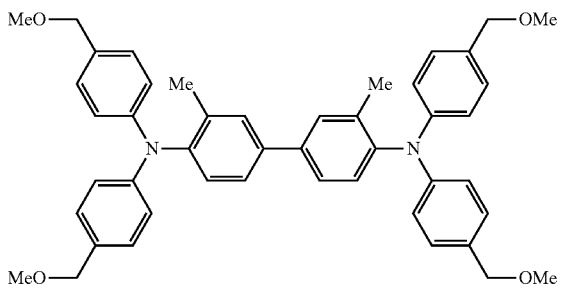

I-35

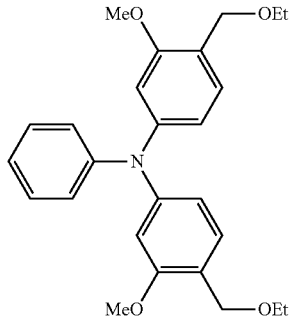

I-36

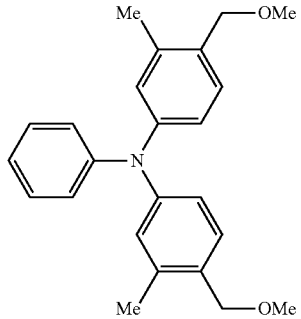

I-37

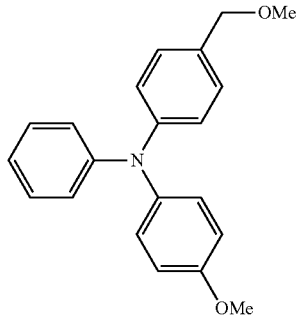

The mixing ratio of the hydroxyl group-containing charge transporting material (A) and the alkoxy group-containing charge transporting material (B) (amount of (A)/amount of (B)) is preferably in the range of 1/20 to 20/1 on a mass basis, and more preferably in the range of 10/1 to 2/1.

Furthermore, the protective layer 2C may use another charge transporting material having a reactive functional group in combination, in addition to the compounds represented by the formulas (I-1) and (I-2). For example, at least one charge transporting material having a structure represented by the following formula (III) may also be used in combination.

$$F—((—R^1—X)_{n1}(R^2)_{n3}—Y)_{n2} \quad \text{(III)}$$

wherein in the formula (III), F represents an organic group derived from a compound having hole transport ability; $R^1$ and $R^2$ each independently represent a linear or branched alkylene group having from 1 to 5 carbon atoms; n1 represents 0 or 1; n2 represents an integer from 1 to 4; n3 represents 0 or 1; X represents any one selected from an oxygen atom, a sulfur atom and a —NH— group; and Y represents a $—NH_2$, —SH or —COOH group.

When another charge transporting material of formula (III) or the like is used in combination, it is preferable to use all the charge transporting materials in an amount of 90% by mass or more based on the total amount of monomers that constitute the solids content of the surface layer (protective layer 2C in the first embodiment), and to polymerize the charge transporting materials.

(Guanamine Compound)

The protective layer 2C formed by polymerizing the hydroxyl group-containing charge transporting material (A) and the alkoxy group-containing charge transporting material (B), may be formed by further polymerizing the materials together with at least one selected from guanamine compounds.

First, guanamine compounds will be described.

A guanamine compound is a compound having a guanamine skeleton (structure), and examples thereof include acetoguanamine, benzoguanamine, formoguanamine, stearoguanamine, spiroguanamine, and cyclohexylguanamine.

The guanamine compound is particularly desirably at least one of compounds represented by the following formula (A) and multimers thereof. Here, the multimers are oligomers in which a compound represented by the formula (A) is polymerized as a structural unit, and the degree of polymerization is, for example, from 2 to 200 (desirably from 2 to 100). In addition, the compound represented by the formula (A) may be used alone, and two or more kinds may also be used in combination.

(A)

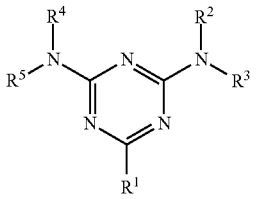

In the formula (A), $R^1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms; $R^2$ to $R^5$ each independently represent hydrogen, $—CH_2—OH$, or $—CH_2—O—R^6$; and $R^6$ represents a hydrogen atom or a linear or branched alkyl group having 1 to 10 carbon atoms.

In the formula (A), the alkyl group represented by $R^1$ has from 1 to 10 carbon atoms, but desirably has from 1 to 8 carbon atoms, and more desirably from 1 to 5 carbon atoms. Also, this alkyl group may be linear or may be branched.

In the formula (A), the phenyl group represented by $R^1$ has from 6 to 10 carbon atoms, but more desirably has from 6 to 8 carbon atoms. Examples of the substituents substituted on this phenyl group include a methyl group, an ethyl group, and a propyl group.

In the formula (A), the alicyclic hydrocarbon group represented by $R^1$ has from 4 to 10 carbon atoms, but more desirably has from 5 to 8 carbon atoms. Examples of the substituent substituted on this alicyclic hydrocarbon group include a methyl group, an ethyl group, and a propyl group.

In the formula (A), the alkyl group represented by $R^6$ in the "—$CH_2$—O—$R^6$" represented by $R^2$ to $R^5$ has from 1 to 10 carbon atoms, but desirably has from 1 to 8 carbon atoms, and more desirably from 1 to 6 carbon atoms. This alkyl group may be linear or may be branched. Desirable examples of the alkyl group include a methyl group, an ethyl group, and a butyl group.

The compound represented by the formula (A) is particularly desirably a compound in which $R^1$ represents a substituted or unsubstituted phenyl group having from 6 to 10 carbon atoms, and $R^2$ to $R^5$ each independently represent —$CH_2$—O—$R^6$. Furthermore, $R^6$ is desirably selected from a methyl group and an n-butyl group.

The compound represented by the formula (A) is, for example, synthesized by a known method (see, for example, Lectures on Experimental Chemistry, 4th Edition, Vol. 28, p. 430) using guanamine and formaldehyde.

Specific examples of the compound represented by the formula will be shown below, but are not limited to these. Furthermore, although the following specific examples represent monomers, the compound represented by the formula (A) may also be a multimer (oligomer) having these monomers as structural units.

(A)-1

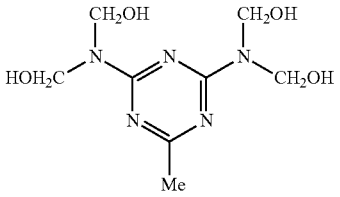

(A)-2

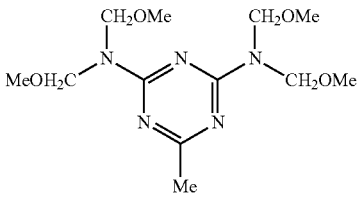

(A)-3

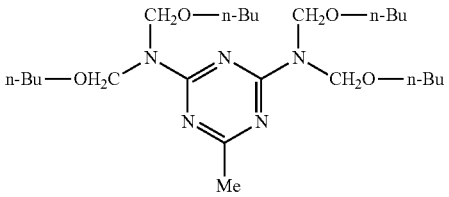

(A)-4

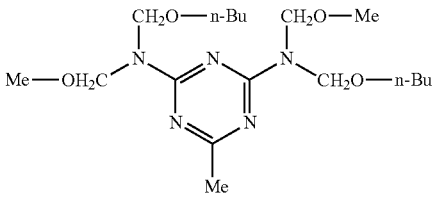

-continued (A)-5

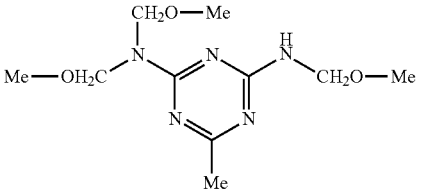

(A)-6

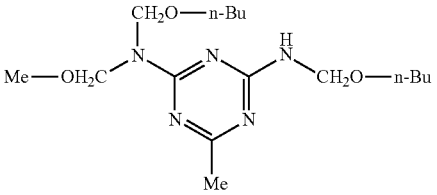

(A)-7

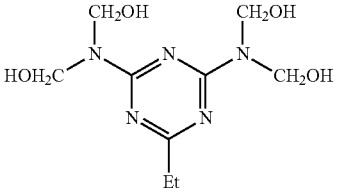

(A)-8

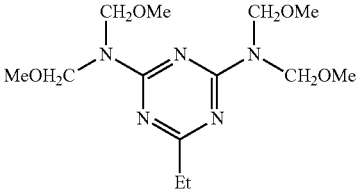

(A)-9

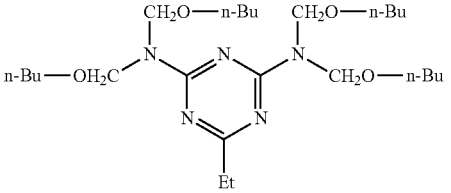

(A)-10

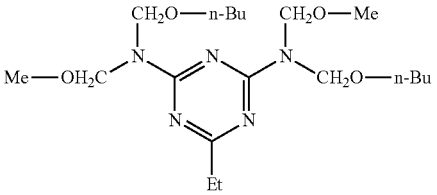

(A)-11

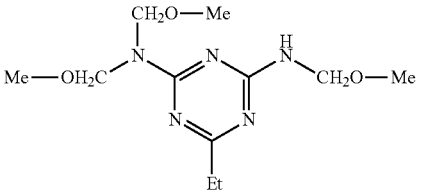

(A)-12

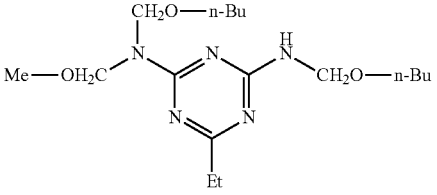

-continued
(A)-13
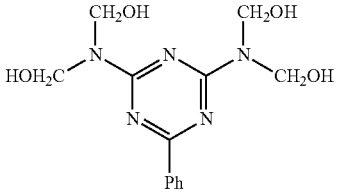
(A)-14
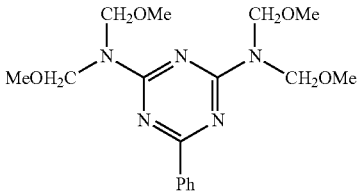
(A)-15
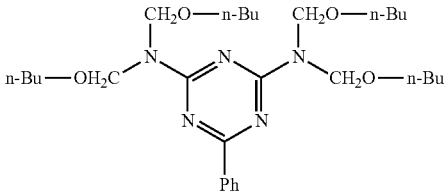
(A)-16
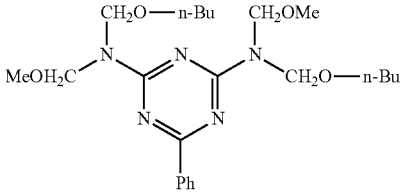
(A)-17
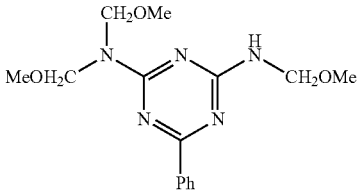
(A)-18
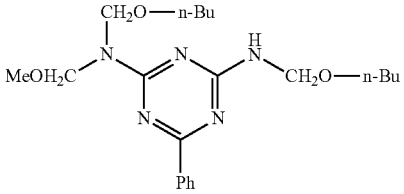
(A)-19
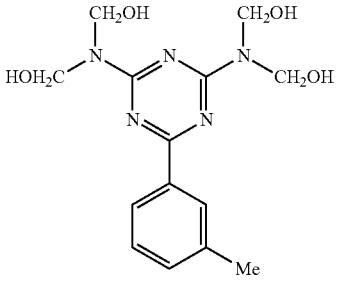
-continued
(A)-20
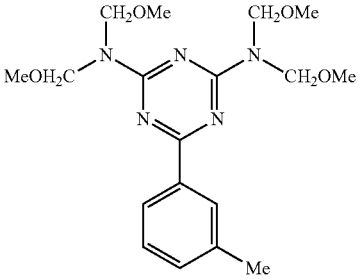
(A)-21
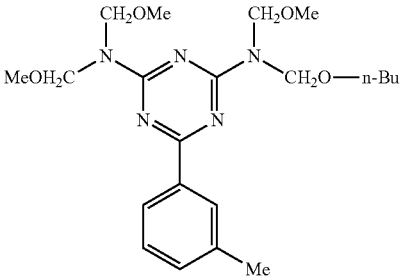
(A)-22
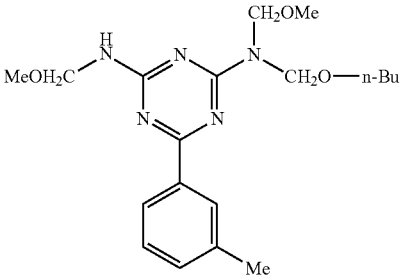
(A)-23
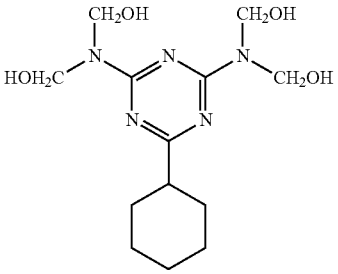
(A)-24
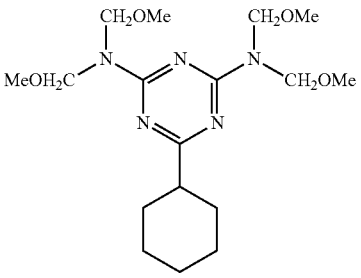

-continued
(A)-25
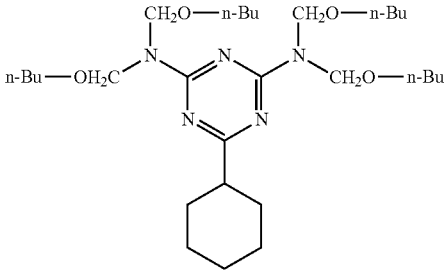
(A)-26
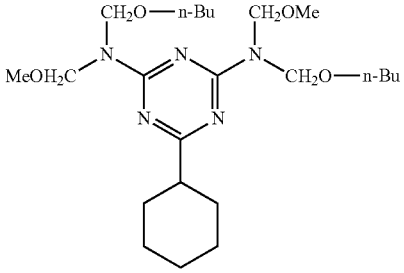
(A)-27
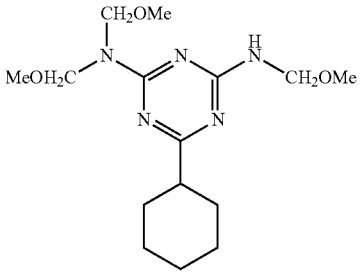
(A)-28
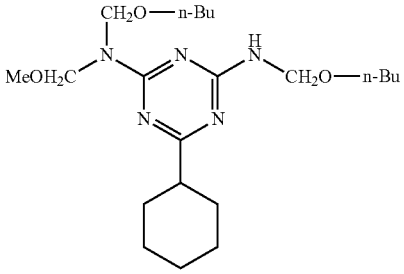
(A)-29
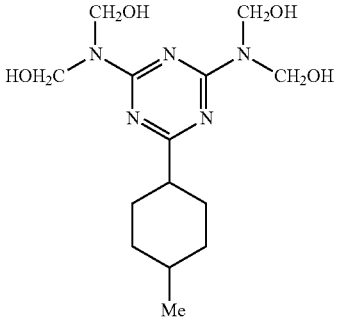
-continued
(A)-30
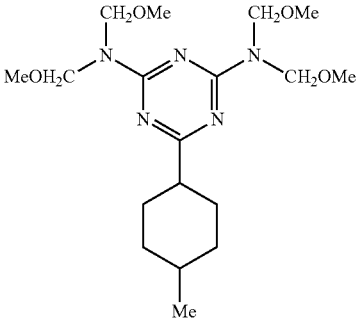
(A)-31
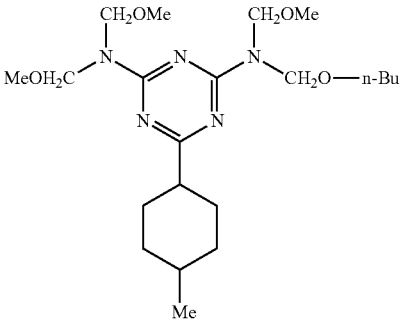
(A)-32
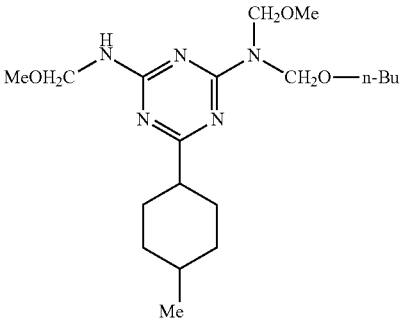
(A)-33
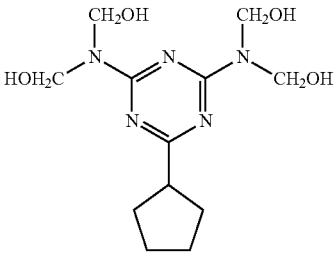
(A)-34
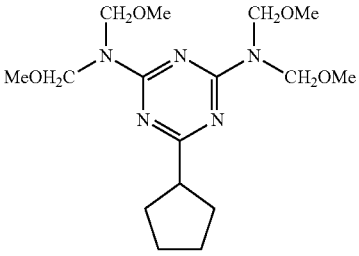

-continued (A)-35

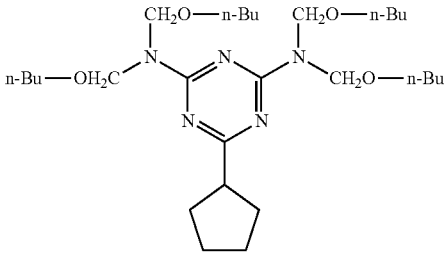

(A)-36

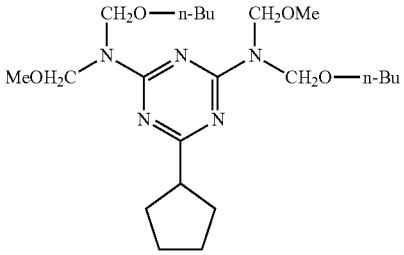

(A)-37

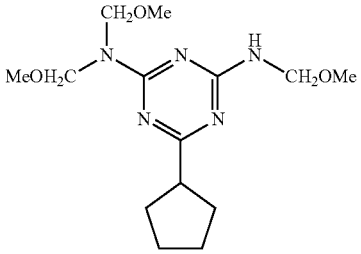

(A)-38

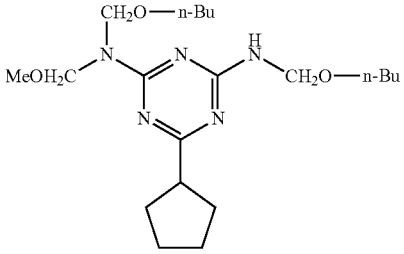

(A)-39

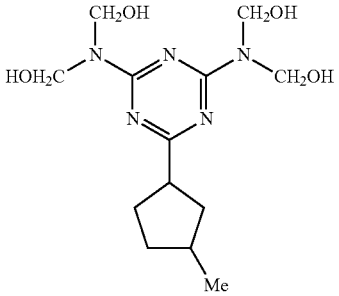

(A)-40

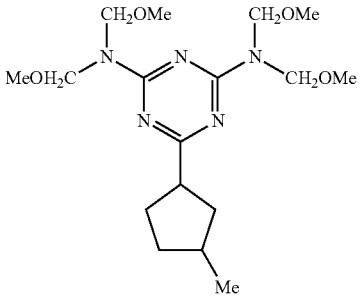

-continued (A)-41

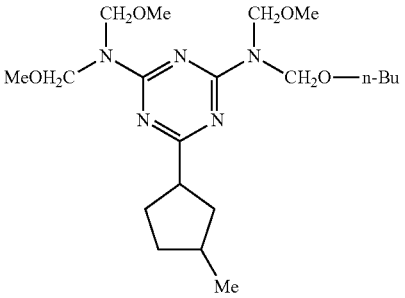

(A)-42

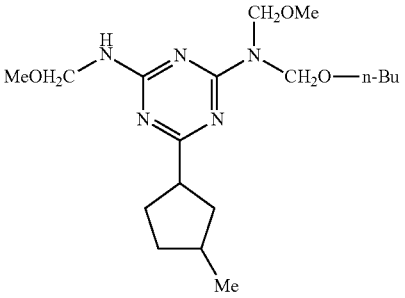

Examples of commercially available products of the compound represented by the formula (A) include "SUPER BECKAMINE® L-148-55, SUPER BECKAMINE® 13-535 SUPER BECKAMINE® L-145-60, SUPER BECKAMINE® TD-126" (all manufactured by DIC Corp.), "NIKALAC BL-60, and "NIKALAC BX-4000" (all manufactured by Nippon Carbide Industries Co., Inc.).

Furthermore, in order to eliminate the influence of the residual catalyst after the synthesis or the purchase of commercially available products, the compounds (including multimers) represented by the formula (A) may be dissolved in an appropriate solvent such as toluene, xylene or ethyl acetate, and then washed with distilled water, ion-exchanged water or the like, or treated with an ion-exchange resin.

Here, the solids content concentration of at least one selected from the guanamine compounds in the coating liquid for surface layer (protective layer 2C in the first embodiment) formation is preferably from 0.1% by mass to 5% by mass, and more preferably from 1% by mass to 3% by mass.

(Other Compositions)

In the protective layer 2C, other thermosetting resins such as a phenolic resin, a xylene-formaldehyde resin, a urea resin, an alkyd resin, and a benzoguanamine resin may be used as a mixture with the cross-linked product in which a specific charge transporting material has been cross-linked. Furthermore, a compound having more functional groups in one molecule, such as a spiroacetal-based guanamine resin (for example, "CTU-GUANAMINE" (manufactured by Ajinomoto Fine Techno Co., Inc.)), may also be copolymerized with the materials in the cross-linked product.

The protective layer 2C may contain fluororesin particles. The fluororesin particles are not particularly limited, but it is desirable to select one kind or two or more kinds from a tetrafluoroethylene resin (PTFE), a trifluorochloroethylene resin, a hexafluoropropylene resin, a vinyl fluoride resin, a vinylidene fluoride resin, a difluorodichloroethylene resin, and copolymers thereof. It is more desirable to select a tetrafluoroethylene resin or a vinylidene fluoride resin, and it is particularly desirable to select a tetrafluoroethylene resin.

The content of the fluororesin particles in the total solids content of the protective layer 2C as the surface layer, is desirably from 1% by mass to 30% by mass, and more desirably from 2% by mass to 20% by mass.

Furthermore, it is preferable to add a surfactant to the protective layer 2C, and the surfactant used is not particularly limited as long as it is a surfactant containing a fluorine atom and at least one kind of an alkylene oxide structure and a silicone structure. However, a surfactant having a plural number of the structures may be suitable.

Various examples of the surfactant containing a fluorine atom are available. Specific examples of the surfactant having a fluorine atom and an acrylic structure include POLYFLOW KL600 (manufactured by Kyoeisha Chemical Co., Ltd.), EFTOP EF-351, EF-352, EF-801, EF-802, and EF-601 (manufactured by JEMCO, Inc.). Examples of the surfactant having an acrylic structure include compounds obtained by polymerizing or copolymerizing monomers such as acrylic or methacrylic compounds.

Furthermore, specific suitable examples of the surfactant having a perfluoroalkyl group as a fluorine atom moiety include perfluoroalkylsulfonic acids (for example, perfluorobutanesulfonic acid, and perfluorooctanesulfonic acid), perfluoroalkylcarboxylic acids (for example, perfluorobutanecarboxylic acid, and perfluorooctanecarboxylic acid), and perfluoroalkyl group-containing phosphoric acid esters. The perfluoroalkylsulfonic acids and perfluoroalkylcarboxylic acids may also be in the form of salts thereof and amide modification products thereof.

Examples of commercially available products of the perfluoroalkylsulfonic acids include MEGAFAC F-114 (manufactured by DIC Corp.), EFTOP EF-101, EF-102, EF-103, EF-104, EF-105, EF-112, EF-121, EF-122A, EF-122B, EF-122C, EF-123A (all manufactured by JEMCO, Inc.), A-K, and 501 (all manufactured by Neos Co., Ltd.).

Examples of commercially available products of the perfluoroalkylcarboxylic acids include MEGAFAC F-410 (manufactured by DIC Corp.), EFTOP EF-201, and EF-204 (all manufactured by JEMCO, Inc.).

Examples of commercially available products of the perfluoroalkyl group-containing phosphoric acid esters include MEGAFAC F-493, F-494 (all manufactured by DIC Corp.) EFTOP EF-123A, EF-123B, EF-125M, and EF-132 (all manufactured by JEMCO, Inc.).

Examples of the surfactant having an alkylene oxide structure include polyethylene glycol, polyether defoamants, and polyether-modified silicone oils. The polyethylene glycol is preferably a compound having a number average molecular weight of 2000 or less. Examples of polyethylene glycol having a number average molecular weight of 2000 or less include polyethylene glycol 2000 (number average molecular weight 2000), polyethylene glycol 600 (number average molecular weight 600), polyethylene glycol 400 (number average molecular weight 400), and polyethylene glycol 200 (number average molecular weight 200).

Furthermore, examples of the polyether defoamants include PE-M, PE-L (all manufactured by Wako Pure Chemical Industries, Ltd.), Defoamant No. 1, and Defoamant No. 5 (all manufactured by Kao Corp.).

Examples of the surfactant having a silicone structure include general silicone oils such as dimethylsilicone, methylphenylsilicone, diphenylsilicone and derivatives thereof.

Examples of the surfactant having both a fluorine atom and an alkylene oxide structure include compounds having an alkylene oxide structure or a polyalkylene structure in aside chain, and compounds having an alkylene oxide structure or a polyalkylene oxide structure in which the ends of the structures are substituted with substituents containing fluorine. Specific examples of the surfactant having an alkylene oxide structure include MEGAFAC F-443, F-444, F-445, F-446 (all manufactured by DIC Corp.), POLYFOX PF636, PF6320, PF6520, and PF656 (all manufactured by Kitamura Chemicals Co., Ltd.).

Furthermore, examples of the surfactant having both an alkylene oxide structure and a silicone structure include KF351 (A), KF352 (A), KF353 (A), KF354 (A), KF355 (A), KF615(A), KF618, KF945(A), KF6004 (all manufactured by Shin-Etsu Chemical Co., Ltd.), TSF4440, TSF4445, TSF4450, TSF4446, TSF4452, TSF4453, TSF4460 (all manufactured by GE Toshiba Silicones Co., Ltd.), BYK-300, 302, 306, 307, 310, 315, 320, 322, 323, 325, 330, 331, 333, 337, 341, 344, 345, 346, 347, 348, 370, 375, 377, 378, UV3500, UV3510, and UV3570 (all manufactured by BYK-Chemie Japan K.K.).

The content of the surfactant is preferably from 0.01% by mass to 1% by mass, and more preferably from 0.02% by mass to 0.5% by mass, based on the total solids content of the protective layer.

The protective layer 2C may further contain other coupling agents and fluorine compounds in a mixture. As these compounds, various silane coupling agents and commercially available silicone-based hardcoat agents are used.

Examples of the silane coupling agents that may be used include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane. Examples of commercially available hardcoat agents that may be used include KP-85, X-40-9740, X-8239 (all manufactured by Shin-Etsu Chemical Co., Ltd.), AY42-440, AY42-441, and AY49-208 (all manufactured by Dow Corning Toray Silicone Co., Ltd.). Furthermore, for the purpose of imparting water repellency or the like, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H, 1H, 2H, 2H-perfluorooctyltriethoxysilane may also be added. The silane coupling agents may be used in any amounts, but it is desirable to adjust the amount of the fluorine-containing compounds to 0.25-fold or less of the mass of the compounds that do not contain fluorine.

The protective layer may also contain a resin which dissolves in an alcohol. Here, the resin which is soluble in alcohol means a resin which may dissolve in an amount of 1% by mass or more in an alcohol having 5 or fewer carbon atoms. Examples of the resin which is soluble in an alcohol-based solvent include polyvinyl acetal resins (for example, S-LEC B and K, manufactured by Sekisui Chemical Co., Ltd.), such as a polyvinyl butyral resin, a polyvinyl formal resin, a partially acetalized polyvinyl acetal resin in which a portion of butyral moieties have been modified with formal or acetoacetal; polyimide resins, cellulose resins, and polyvinylphenol resins. Particularly, polyvinyl acetal resins and polyvinylphenol resins are desirable.

The weight average molecular weight of those resins is desirably from 2,000 to 100,000, and more desirably from 5,000 to 50,000. The amount of addition of those resins is desirably from 1% by mass to 40% by mass, more desirably from 1% by mass to 30% by mass, and even more desirably from 5% by mass to 20% by mass.

The protective layer 2C may also contain an antioxidant. The antioxidant is desirably a hindered phenol-based antioxidant or a hindered amine-based antioxidant, and known antioxidants such as organosulfur-based antioxidants, phosphite-based antioxidants, dithiocarbamate-based antioxidants, thiourea-based antioxidants, and benzimidazole-based antioxidants may also be used. The amount of the antioxidant added is desirably 20% by mass or less, and more desirably 10% by mass or less.

Examples of the hindered phenol-based antioxidants include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxybenzylphosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

Furthermore, various particles may be added to the protective layer. An example of such particles may be silicon-containing particles. Silicon-containing particles are particles containing silicon as a constituent element, and specific examples include colloidal silica and silicone particles. The colloidal silica that is used as a kind of silicon-containing particles is selected from products prepared by dispersing silica having an average particle size of from 1 nm to 100 nm, and preferably from 10 nm to 30 nm, in an acidic or alkaline aqueous dispersion liquid, or an organic solvent such as an alcohol, a ketone or an ester, and products that are commonly sold in the market may also be used. The solids content of the colloidal silica in the protective layer 2C is not particularly limited, but the colloidal silica is used in an amount in the range of from 0.1% by mass to 50% by mass, and more desirably from 0.1% by mass to 30% by mass, based on the total solids content of the protective layer.

The silicone particles used as a kind of the silicon-containing particles are selected from silicone resin particles, silicone rubber particles, and silicone-surface treated silica particles, and products that are commonly sold in the market may also be used. These silicone particles are spherical in shape, and the average particle size is desirably from 1 nm to 500 nm, and more desirably from 10 nm to 100 nm. Silicone particles are particles that are chemically inert and have excellent dispersibility in resins. The content of the silicone particles in the protective layer is desirably from 0.1% by mass to 30% by mass, and more desirably from 0.5% by mass to 10% by mass, based on the total solids content of the protective layer.

In addition, other examples of such particles include fluorine-based particles such as particles of tetrafluoroethylene, trifluoroethylene, hexafluoropropylene, vinyl fluoride, and vinylidene fluoride; particles formed from resins produced by copolymerizing a fluororesin and a monomer having a hydroxyl group, such as those described in the "Proceedings of the 8$^{th}$ Polymer Materials Forum", p. 89; and particles of semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO.

Oils such as silicone oils may also be added to the protective layer. Examples of the silicone oils include silicone oils such as dimethylpolysiloxane, diphenylpolysiloxane, and phenylmethylsiloxane; reactive silicone oils such as amino-modified polysiloxane, epoxy-modified polysiloxane, carboxy-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as methylhydrosiloxane mixtures, pentamethylcyclopentasiloxane, and phenylhydrocyclosiloxane; and vinyl group-containing cyclosiloxanes such as pentavinylpentamethylcyclopentasiloxane.

The protective layer may also contain a metal, a metal oxide, carbon black, and the like. Examples of the metal include aluminum, zinc, copper, chromium, nickel, silver and stainless steel, and plastic particles having these metals deposited on the particle surfaces may also be used. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These compounds may be used individually, or two or more kinds may be used in combination. When two or more kinds are used in combination, the compounds may be used as simple mixtures, or may be used in the form of solid solution or fusion. The average particle size of electrically conductive particles is desirably 0.3 μm or less, and particularly desirably 0.1 μm or less.

A curing catalyst for accelerating the curing of the guanamine compound or the specific charge transport material may be incorporated into the protective layer 2C. As the curing catalyst, acid-based catalysts are desirably used. Examples of the acid-based catalysts that may be used include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic and aromatic sulfonic acids such as methanesulfonic acid, dodecylsulfonic acid, benzenesulfonic acid, dodecylbenzenesulfonic acid, and naphthalenesulfonic acid, but it is desirable to use sulfur-containing materials.

It is desirable that the sulfur-containing materials as curing catalysts exhibit acidity at normal temperature (for example, 25° C.) or after heating, and at least one of organic sulfonic acids and derivatives thereof is most desirable. The presence of these catalysts in the protective layer 2C is easily confirmed by an energy dispersive X-ray analysis (EDS), an X-ray photoelectron spectroscopic method (XPS), or the like.

Examples of the organic sulfonic acids and/or derivatives thereof include para-toluenesulfonic acid, dinonylnaphthalenesulfonic acid (DNNSA), dinonylnaphthalenedisulfonic acid (DNNDSA), dodecylbenzenesulfonic acid, and phenolsulfonic acid. Among these, para-toluenesulfonic acid and dodecylbenzenesulfonic acid are desirable. Furthermore, organic sulfonic acid salts may also be used as long as the salts may be dissociated in a curable resin composition.

Furthermore, a so-called thermal latent catalyst, which acquires higher catalytic capacity when heat is applied, may also be used.

Examples of the thermal latent catalyst include products produced by adsorbing acids or the like to vacancy compounds such as microcapsules in which organic sulfone compounds and the like are encapsulated with polymers into a particulate form, and zeolites; thermal latent protonic acid catalysts obtained by blocking protonic acids and/or protonic acid derivatives with bases; products obtained by esterifying protonic acids and/or protonic acid derivatives with primary or secondary alcohols; products obtained by blocking protonic acids and/or protonic acid derivatives with vinyl ethers and/or vinyl thioethers; boron trifluoride-monoethylamine complexes; and boron trifluoride-pyridine complexes.

Among them, the products obtained by blocking protonic acids and/or protonic acid derivatives with bases are desirable.

Examples of the protonic acids for the thermal latent protonic acid catalysts include sulfonic acid, hydrochloric acid, acetic acid, formic acid, nitric acid, phosphoric acid, sulfonic acid, monocarboxylic acids, polycarboxylic acids, propionic acid, oxalic acid, benzoic acid, acrylic acid, methacrylic acid, itaconic acid, phthalic acid, maleic acid, benzenesulfonic acid, o, m, p-toluenesulfonic acids, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Furthermore, examples of the protonic acid derivatives include neutralization products of alkali metal salts or alkaline earth metal salts of protonic acids such as sulfonic acid and phosphoric acid; and polymer compounds (polyvinylsulfonic acid, and the like) having a protonic acid skeleton introduced into the polymer chain. Examples of the bases blocking protonic acids include amines.

Amines are classified into primary, secondary or tertiary amines. There are no particular limitations, and all of these amines may be used.

Examples of the primary amines include methylamine, ethylamine, propylamine, isopropylamine, n-butylamine, isobutylamine, t-butylamine, hexylamine, 2-ethylhexylamine, secondary butylamine, allylamine, and methylhexylamine.

Examples of the secondary amines include dimethylamine, diethylamine, di-n-propylamine, diisopropylamine, di-n-butylamine, diisobutylamine, di-t-butylamine, dihexylamine, di-(2-ethylhexyl)amine, N-isopropyl-N-isobutylamine, di-sec-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri-(2-ethylhexyl)amine, N-methylmorpholine, N,N-dimethylallylamine, N-methyldiallylamine, triallylamine, N,N-diethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-corydine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of commercially available products include "NACURE 2501" (toluenesulfonic acid dissociation, methanol/isopropanol solvent, from pH 6.0 to pH 7.2, dissociation temperature 80° C.), "NACURE 2107" (p-toluenesulfonic acid dissociation, isopropanol solvent, from pH 8.0 to pH 9.0, dissociation temperature 90° C.), "NACURE 2500" (p-toluenesulfonic acid dissociation, isopropanol solvent, from pH 6.0 to pH 7.0, dissociation temperature 65° C.), "NACURE 2530" (p-toluenesulfonic acid dissociation, methanol/isopropanol solvent, from pH 5.7 to pH 6.5, dissociation temperature 65° C.), "NACURE 2547" (p-toluenesulfonic acid dissociation, aqueous solution, from pH 8.0 to pH 9.0, dissociation temperature 107° C.), "NACURE 2558" (p-toluenesulfonic acid dissociation, aqueous ethylene glycol solvent, from pH 3.5 to pH 4.5, dissociation temperature 80° C.), "NACURE XP-357" (p-toluenesulfonic acid dissociation, methanol solvent, from pH 2.0 to pH 4.0, dissociation temperature 65° C.), "NACURE XP-386" (p-toluenesulfonic acid dissociation, aqueous solution, from pH 6.1 to pH 6.4, dissociation temperature 80° C.), "NACURE XC-2211" (p-toluenesulfonic acid dissociation, from pH 7.2 to pH 8.5, dissociation temperature 80° C.), "NACURE 5225" (dodecylbenzenesulfonic acid dissociation, isopropanol solvent, from pH 6.0 to pH 7.0, dissociation temperature 120° C.), "NACURE 5414" (dodecylbenzenesulfonic acid dissociation, xylene solvent, dissociation temperature 120° C.), "NACURE 5528" (dodecylbenzenesulfonic acid dissociation, isopropanol solvent, from pH 7.0 to pH 8.0, dissociation temperature 120° C.), "NACURE 5925" (dodecylbenzenesulfonic acid dissociation, from pH 7.0 to pH 7.5, dissociation temperature 130° C.), "NACURE 1323" (dinonylnaphthalenesulfonic acid dissociation, xylene solvent, from pH 6.8 to pH 7.5, dissociation temperature 150° C.), "NACURE 1419" (dinonylnaphthalenesulfonic acid dissociation, xylene/methyl isobutyl ketone solvent, dissociation temperature 150° C.), "NACURE 1557" (dinonylnaphthalenesulfonic acid dissociation, butanol/2-butoxyethanol solvent, from pH 6.5 to pH 7.5, dissociation temperature 150° C.), "NACURE X49-110" (dinonylnaphthalenedisulfonic acid dissociation, isobutanol/isopropanol solvent, from pH 6.5 to pH 7.5, dissociation temperature 90° C.), "NACURE 3525" (dinonylnaphthalenedisulfonic acid dissociation, isobutanol/isopropanol solvent, from pH 7.0 to pH 8.5, dissociation temperature 120° C.), "NACURE XP-383" (dinonylnaphthalenedisulfonic acid dissociation, xylene solvent, dissociation temperature 120° C.), "NACURE 3327" (dinonylnaphthalenedisulfonic acid dissociation, isobutanol/isopropanol solvent, from pH 6.5 to pH 7.5, dissociation temperature 150° C.), "NACURE 4167" (phosphoric acid dissociation, isopropanol/isobutanol solvent, from pH 6.8 to pH 7.3, dissociation temperature 80° C.), "NACURE XP-297"(phosphoric acid dissociation, water/isopropanol solvent, from pH 6.5 to pH 7.5, dissociation temperature 90° C.), and "NACURE 4575" (phosphoric acid dissociation, from pH 7.0 to pH 8.0, dissociation temperature 110° C.), manufactured by King Industries, Inc.

These thermal latent catalysts may be used individually or in combination of two or more kinds.

Here, the amount of the catalyst incorporated is desirably in the range of from 0.1% by mass to 10% by mass, and particularly desirably from 0.1% by mass to 5% by mass, based on the total solids content in the coating liquid, excluding the fluororesin particles and the fluoroalkyl group-containing copolymer.

(Method for Forming Surface Layer)

Here, as an example of the process for forming a surface layer in the production of the photoreceptor according to the exemplary embodiment of the invention, the method for forming a protective layer 2C which is the surface layer in the photoreceptor according to the first embodiment will be described.

First, the method for producing the photoreceptor of the first embodiment includes a conductive substrate preparation step for preparing a conductive substrate 1 on which layers other than the surface layer (that is, protective layer 2C) (that is, undercoat layer 4, charge generating layer 2A, charge transport layer 2B, and the like) are formed; and a surface layer formation step for applying a coating liquid containing the specific charge transporting material and other compositions on the conductive substrate and polymerizing the coating liquid to form a surface layer (that is, protective layer 2C).

Examples of the solvent used in the formation of the protective layer 2C as the surface layer include cyclic aliphatic ketone compounds such as cyclobutanone, cyclopentanone, cyclohexanone, and cycloheptanone; cyclic or linear alcohols such as methanol, ethanol, propanol, butanol, and cyclopentanol; linear ketones such as acetone and methyl ethyl ketone; cyclic or linear ethers such as tetrahydrofuran, dioxane, ethylene glycol, and diethyl ether; and halogenated aliphatic hydrocarbons such as methylene chloride, chloroform, and ethylene chloride.

Examples of the method of coating the coating liquid for film formation for forming the protective layer 2C as the surface layer include a toss coating method, a ring coating method, a blade coating method, a wire coating method, a spray coating method, a dipping coating method, a bead coating method, an air knife coating method, a curtain coating method, and an inkjet coating method. After coating, the coating liquid is heated to a temperature of, for example, from 100° C. to 170° C. and cured (cross-linked), and thus the protective layer 2C is obtained.

The thickness of the surface layer according to the exemplary embodiment of the invention is preferably from 5 μm to 20 μm, and more preferably from 7 μm to 15 μm.

Photoreceptor of Second Embodiment

Surface Layer=Charge Transport Layer

The photoreceptor of the second embodiment, which is an example according to the exemplary embodiment, has a layer configuration in which an undercoat layer 4, a charge generating layer 2A and a charge transport layer 2B are laminated in this order on the conductive substrate 1, as shown in FIG. 2, and the charge transport layer 2B is the surface layer.

As the conductive substrate 1, undercoat layer 4 and charge generating layer 2A in the photoreceptor of the second embodiment, the conductive substrate 1, undercoat layer 4 and charge generating layer 2A according to the photoreceptor of the first embodiment as shown in FIG. 1 are directly applied. Furthermore, as the charge transport layer 2B in the photoreceptor of the second embodiment, the protective layer 2C in the photoreceptor of the first embodiment as shown in FIG. 1 is directly applied.

[Image Forming Apparatus]

Figure 3:
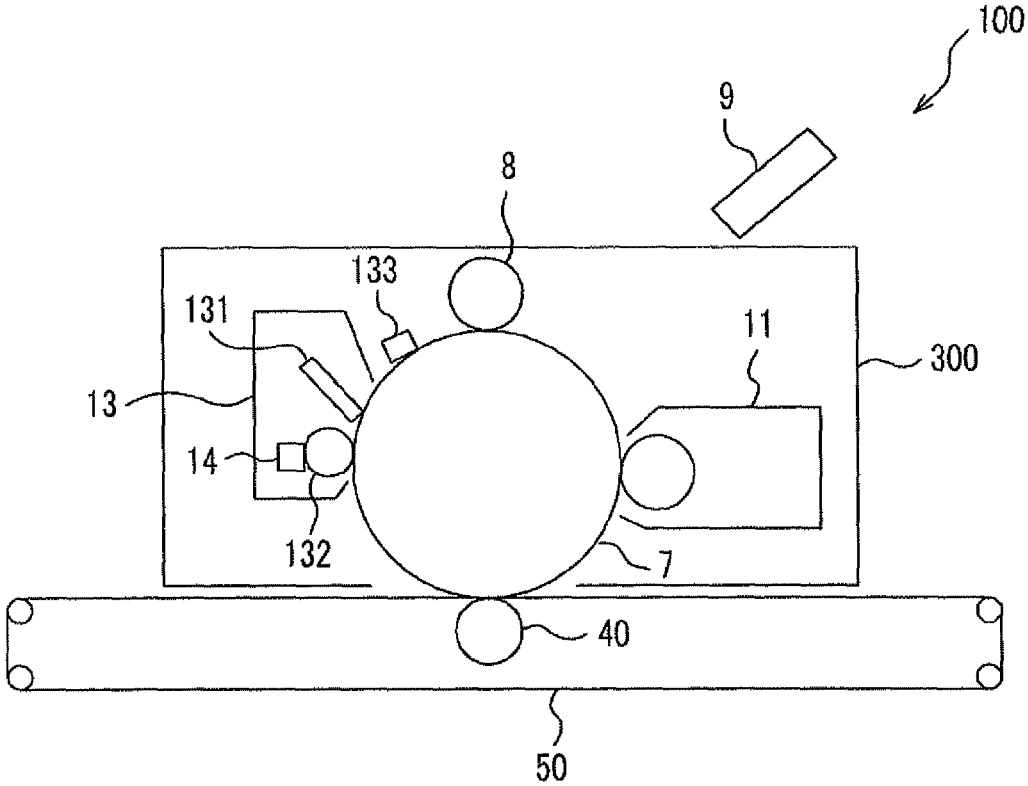
FIG. 3 is a schematic configuration diagram showing an image forming apparatus according to the exemplary embodiment of the invention.

FIG. 3 is a schematic configuration diagram showing an image forming apparatus according to the exemplary embodiment of the invention. The image forming apparatus 100 includes, as shown in FIG. 3, a process cartridge 300 having an electrophotographic photoreceptor 7, an exposure device 9, a transfer device 40, and an intermediate transfer body 50. In the image forming apparatus 100, the exposure device 9 is disposed at a position where the electrophotographic photoreceptor 7 may be exposed through the opening of the process cartridge 300, and the transfer device 40 is disposed at a position opposite to the electrophotographic photoreceptor 7 through the intermediate transfer body 50. The intermediate transfer body 50 is disposed such that a part thereof is in contact with the electrophotographic photoreceptor 7.

The process cartridge 300 in FIG. 3 supports any one of an electrophotographic photoreceptor 7, a charging device 8, a developing device 11 and a cleaning device 13 in a casing. The cleaning device 13 has a cleaning blade 131 (blade member) formed from an elastic material such as rubber, and the cleaning blade 131 is disposed such that an edge is in contact with the surface of the electrophotographic photoreceptor 7, and a method for removing the developer such as the toner adhering to the surface of the electrophotographic photoreceptor 7 is applied. In addition to this, known cleaning methods such as a method of using a cleaning brush using an electrically conductive plastic, are used.

Furthermore, there are disclosed examples of using fibrous member 132 (roller-shaped) that supplies a lubricating member 14 to the surface of the photoreceptor 7, and a fibrous member 133 (flat brush-shaped) that assists cleaning, but these may be used as necessary.

As the charging device 8, for example, a contact type charging device using a conductive or semiconductive charging roller, a charging brush, a charging film, a charging rubber blade, a charging tube or the like is used. Furthermore, known charging devices, such as a non-contact type roller charging device, a scorotron charging device or corotron charging device using corona discharge, are also used.

Although not depicted in the diagram, a photoreceptor heating member for increasing the temperature of the electrophotographic photoreceptor 7 and thereby lowering the relative temperature may be provided in the periphery of the electrophotographic photoreceptor 7, for the purpose of increasing the stability of images.

The exposure device 9 may be, for example, an optical instrument which exposes imagewise the surface of the photoreceptor 7 to light such as a semiconductor laser light, an LED light, or a liquid crystal shutter light. For the wavelength of the light source, a wavelength that belongs to the spectral sensitivity region of the photoreceptor is used. The principal range of the wavelength of semiconductor laser light is near-infrared having an emission wavelength at near 780 nm. However, the wavelength of the light source is not limited to this wavelength, and a laser light having an emission wavelength in the region of 600 nm, or a blue laser light having an emission wavelength of from 400 nm to 450 nm may also be used. Furthermore, a surface emission type laser light source that may output multiple beams for the formation of multicolor images is also effective.

As the developing device 11, for example, a general developing device which performs development in a contact or non-contact manner using a magnetic or non-magnetic single-component developer, a two-component developer, or the like may be used. The developing device is not particularly limited as long as the device has the function described above, and is selected according to the purpose. For example, a known developing machine having a function of attaching the single-component developer or the two-component developer to the photoreceptor 7 using a brush, a roller or the like, may be used. Among others, it is desirable to use a developing roller which holds the developer at the surface.

Hereinafter, the toner that is used in the developing device 11 will be described.

The toner used in the image forming apparatus of the exemplary embodiment of the invention is such that the average shape coefficient ($(ML^2/A)\times(\pi/4)\times100$, wherein ML represents the maximum length of a particle, and A represents the projection area of the particle) is desirably from 100 to 150, more desirably from 105 to 145, and even more desirably from 110 to 140. Furthermore, the toner desirably has a volume average particle size of from 3 μm to 12 μm, and more desirably from 3.5 μm to 9 μm.

The toner is not particularly limited in terms of the production method, but for example, toners produced by a kneading pulverization method of adding a binder resin, a colorant and a release agent, as well as other additives such as a charge control agent and the like, and performing kneading, pulverization and classification; a method of modifying the shape of the particles obtained by a kneading pulverization method, by means of mechanical impact force or thermal energy; an emulsion polymerization aggregation method of emulsion polymerizing polymerizable monomers of a binder resin, mixing the dispersion liquid thus formed with a dispersion liquid containing a colorant and a release agent, as well as other additives such as a charge control agent, and subjecting the mixture to aggregation and heat coalescence to obtain toner particles; a suspension polymerization method of suspending polymerizable monomers for obtaining a binder resin, and a solution containing a colorant and a release agent, as well as other additives such as a charge control agent, in an aqueous solvent, and performing polymerization; a dissolution suspension method of suspending a binder resin, and a solution containing a colorant and a release agent, as well as other additives such as a charge control agent, in an aqueous solvent, and granulating the suspension; and the like are used.

Furthermore, known methods such as a production method of using a toner obtained by the methods described above as the core, further attaching aggregated particles thereto, and thermally fusing the toner and the particles to give a core-shell structure, are used. As the method for producing a toner, a suspension polymerization method, an emulsion polymerization aggregation method, and a dissolution suspension method, which produce toners in aqueous solvents, are desirable from the viewpoints of controlling the shape and the particle size distribution, and an emulsion polymerization aggregation method is particularly desirable.

The toner mother particles desirably contain a binder resin, a colorant and a release agent, and may further contain silica or a charge control agent.

Examples of the binder resin used in the toner mother particles include homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone, and polyester resins obtained by copolymerization of dicarboxylic acids and diols.

Particularly representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a polyester resin. Other examples include polyurethane, an epoxy resin, a silicone resin, polyamide, modified resin, and paraffin wax.

Furthermore, representative examples of the colorant include magnetic components such as magnetite and ferrite; carbon black, aniline blue, calcoil blue, chrome yellow, ultramarine blue, Du Pont oil red, quinoline yellow, methylene blue chloride, phthalocyanine blue, malachite green oxalate, lamp black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Representative examples of the release agent include low molecular weight polyethylene, low molecular weight polypropylene, Fischer-Tropsch wax, montan wax, carnauba wax, rice wax, and candellila wax.

As the charge control agent, known compounds are used, but azo-based metal complexes, salicylic acid-metal complexes, and resin type charge control agents containing polar groups are used. When the toner is produced by a wet production method, it is desirable to use a material that is not easily dissolved in water. Also, the toner may be any of a magnetic toner including a magnetic material, and a non-magnetic toner that does not contain a magnetic material.

The toner used in the developing device 11 is produced by mixing the toner mother particles and the external additives in a Henschel mixer, a V-blender or the like. Furthermore, in the case of producing toner mother particles by a wet method, external addition may be carried out in a wet manner.

Active particles may be added to the toner used in the developing device 11. Examples of the active particles that may be used include particles of solid lubricants such as graphite, molybdenum disulfide, talc, fatty acids, and fatty acid metal salts; low molecular weight polyolefins such as polypropylene, polyethylene, and polybutene; silicones having softening points by heating; aliphatic amides such as oleic acid amide, erucic acid amide, ricinolic acid amide, and stearic acid amide; plant waxes such as carnauba wax, rice wax, candellila wax, wood wax, and jojoba oil; animal waxes such as beeswax; mineral and petroleum waxes such as montan wax, ozokerite, ceresin, paraffin wax, microcrystalline wax, and Fischer-Tropsch wax; and modification products thereof. These may be used individually, or two or more kinds may be used in combination. However, the average particle size is desirably in the range of from 0.1 μm to 10 μm, and products having the chemical structures described above may be pulverized to provide the particles having the same size. The amount of the toner added is preferably in the range of from 0.05% by mass to 2.0% by mass, and more desirably from 0.1% by mass to 1.5% by mass.

The toner used in the developing device 11 may further contain inorganic particles, organic particles, complex particles in which inorganic particles are attached to organic particles, and the like.

Examples of the inorganic particles that may be suitably used include particles of various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

Furthermore, the inorganic particles may be treated with titanium coupling agents such as tetraoctyl titanate, tetraoctyl titanate, isopropyltriisostearoyl titanate, isopropyltridecylbenzenesulfonyl titanate, and bis(dioctylpyrophosphate)oxyacetate titanate; and silane coupling agents such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. Furthermore, inorganic particles that have been subjected to a hydrophobization treatment using silicone oil or higher fatty acid metal salts such as aluminum stearate, zinc stearate, and calcium stearate, are also favorably used.

Examples of the organic particles include styrene resin particles, styrene-acrylic resin particles, acrylic resin particles, polyester resin particles, and urethane resin particles.

In regard to the particle size, particles having a number average particle size of desirably from 5 nm to 1000 nm, more desirably from 5 nm to 800 nm, and even more desirably from 5 nm to 700 nm, are used. Also, it is desirable that the sum of the added amounts of the particles described above and the active particles is 0.6% by mass or greater.

As the other inorganic oxides that are added to the toner, small-sized inorganic oxide particles having a primary particle size of 40 nm or less are used, and it is more desirable to use inorganic oxide particles having larger diameters. Any known compound may be used as these inorganic oxide particles, but it is desirable to use silica and titanium oxide in combination.

The small-sized inorganic particles may also be surface treated. It is also desirable to add carbonates such as calcium carbonate and magnesium carbonate, or inorganic minerals such as hydrotalcite.

The color toner for electrophotography is used as a mixture with a carrier, and examples of the carrier that may be used include powdered iron, glass beads, powdered ferrite, powdered nickel, and products obtained by coating the surfaces of the aforementioned powders and beads with a resin. The mixing ratio of the color toner and the carrier may be defined according to necessity.

Examples of the transfer device 40 include known transfer charging devices, such as contact type transfer charging devices using a belt, a roller, a film, a rubber blade and the like; and scorotron transfer charging devices or corotron transfer charging devices using corona discharge.

Examples of the intermediate transfer body 50 that may be used include belt-shaped transfer bodies (intermediate transfer belts) made of polyimide, polyamideimide, polycarbonate, polyallylate, polyester, rubber and the like, which have been imparted with semiconductivity. Furthermore, in regard to the shape of the intermediate transfer body 50, a transfer body having a drum shape is used in addition to the belt-shaped transfer body.

The image forming apparatus 100 may include, in addition to the various devices described above, for example, a photo-erasing device for photo-erasing the photoreceptor 7.

Figure 4:
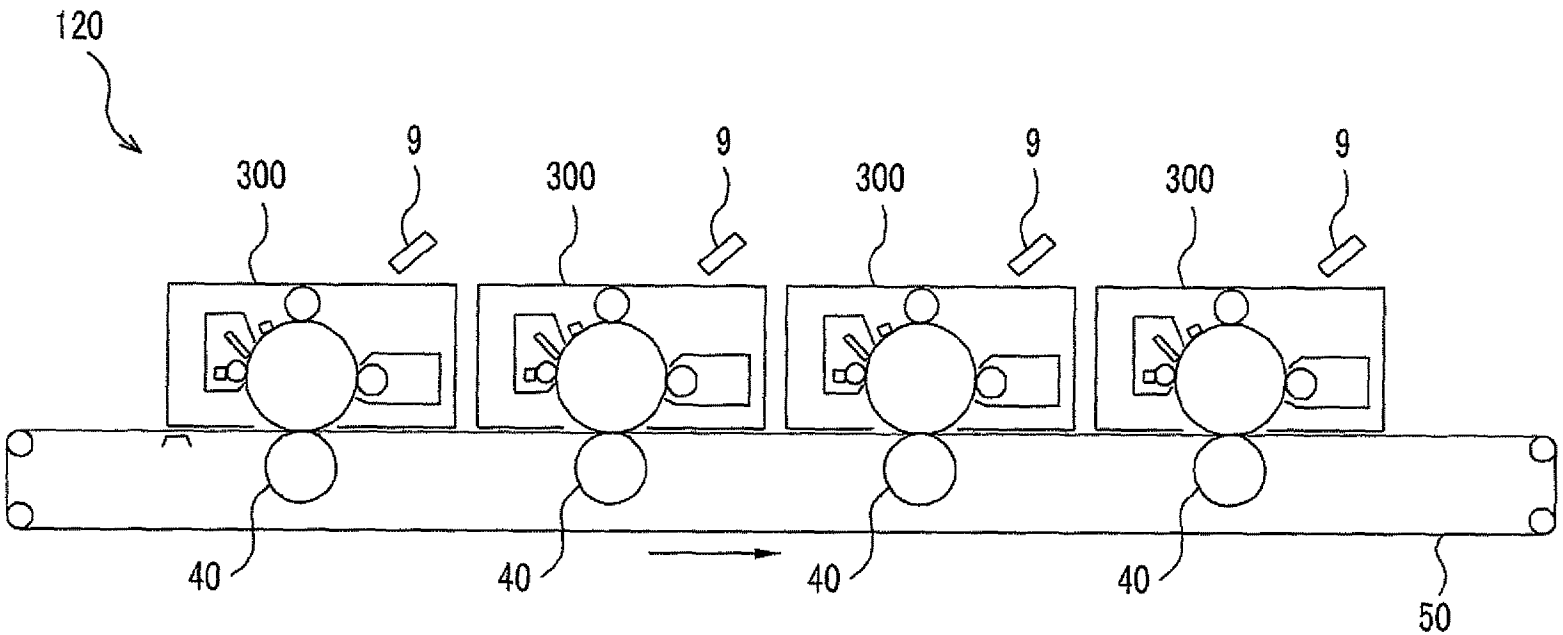
FIG. 4 is a schematic configuration diagram showing another image forming apparatus according to the exemplary embodiment of the invention; and Each of FIGS. 5A, 5B and 5C is a diagram showing the evaluation pattern and the evaluation criteria for the ghost phenomenon.

FIG. 4 is a schematic cross-sectional view showing an image forming apparatus according to another exemplary embodiment. The image forming apparatus 120 is a tandem type full-color image forming apparatus equipped with four process cartridges 300, as show in FIG. 4. The image forming apparatus 120 has a configuration in which four process cartridges 300 are disposed in parallel on the intermediate transfer body 50, and one electrophotographic photoreceptor is used per color. Furthermore, the image forming apparatus 120 has the same configuration as the image forming apparatus 100, except for being a tandem system.

EXAMPLES

Hereinafter, the invention will be described more specifically based on Examples and Comparative Examples, but the invention is not intended to be limited to the following Examples. Furthermore, the units "parts" and "percent (%)" in the following descriptions are on a mass basis, unless particularly stated otherwise.

<Guanamine Resin AG-1>

500 parts of SUPER BECKAMINE® 13-535 (methylated benzoguanamine resin: manufactured by DIC Corp.) having the structure of "(A)-14" described above are dissolved in 400 parts of toluene, and the solution is washed four times using 400 ml of distilled water each time. The conductivity of the final washing water is 10 μS/cm. The solvent of this solution is distilled off under reduced pressure, and 260 parts of a syrup-like resin is obtained. This is designated as guanamine resin AG-1.

<Guanamine Resin AG-2>

NIKALAC BL-60 (manufactured by Nippon Carbide Industries, Ltd.) having the structure of "(A)-17" described above is directly used as guanamine resin AG-2. This resin contains 37% of a xylene-based solvent.

<Xylene Resin AX-1>

A xylene-formaldehyde resin, NIKANOL Y-50 (manufactured by Fudow Co., Ltd.), is used as xylene resin AX-1.

<Catalysts A-1 to A-3>

NACURE 2107 (manufactured by King Industries, Inc.) is used as catalyst A-1.

NACURE 2500 (manufactured by King Industries, Inc.) is used as catalyst A-2.

NACURE 4167 (manufactured by King Industries, Inc.) is used as catalyst A-3.

<Surfactant A-1>

A surfactant having both an alkylene oxide structure and a silicone structure, BYK302 (manufactured by BYK-Chemie Japan K.K.), is used as surfactant A-1.

<Surfactant A-2>

A surfactant having a fluorine atom, SURFLON S-651 (manufactured by AGC Seimi Chemical Co., Ltd.), is used as surfactant A-2.

Example 1

Production of Undercoat Layer 100 parts of zinc oxide (average particle size 70 nm: manufactured by Tayca Corp.: specific surface area 15 $m^2/g$) is mixed under stirring with 500 parts of tetrahydrofuran, and 1.2 parts of a silane coupling agent (KBM502: manufactured by Shin-Etsu Chemical Co., Ltd.) are added to the mixture. The mixture is stirred for 2 hours. Subsequently, toluene is distilled off under reduced pressure, and the residue is calcined for 3 hours at 120° C. Thus, a silane coupling agent-surface treated zinc oxide is obtained.

110 parts of the surface treated zinc oxide is mixed under stirring with 500 parts of tetrahydrofuran, and a solution prepared by dissolving 0.7 part of alizarin in 50 parts of tetrahydrofuran is added to the mixture. The mixture is stirred for 4 hours at 50° C. Subsequently, the zinc oxide combined with alizarin is separated by filtration under reduced pressure, and is dried under reduced pressure at 60° C. Thus, alizarin-applied zinc oxide is obtained.

38 parts of a solution prepared by dissolving 60 parts of this alizarin-applied zinc oxide, 13.5 parts of a curing agent (blocked isocyanate, SUMIJUR 3175, manufactured by Sumitomo Bayer Urethane Co., Ltd.), and 15 parts of a butyral resin (S-LEC BM-1, manufactured by Sekisui Chemical Co., Ltd.) in 85 parts of methyl ethyl ketone are mixed with 30 parts of methyl ethyl ketone, and the mixture is dispersed in a sand mill using glass beads having a diameter of 1 mmϕ for 2.5 hours. Thus, a dispersion liquid is obtained.

0.005 part of dioctyltin dilaurate as a catalyst and 40 parts of silicone resin particles (TOSPEARL 145, manufactured by GE Toshiba Silicones Co., Ltd.) are added to the dispersion liquid thus obtained, and a coating liquid for undercoat layer is obtained. This coating liquid is applied on an aluminum base material having a diameter of 30 mm, a length of 340 mm and a thickness of 1 mm by a dipping coating method, and the coating liquid is dried and cured at 170° C. for 40 minutes. Thus, an undercoat layer having a thickness of 21 μm is obtained.

(Production of Charge Generating Layer)

A mixture of 15 parts of hydroxygallium phthalocyanine having diffraction peaks at Bragg's angles (2θ±0.2°) of at least 7.3°, 16.0°, 24.9°, and 28.0° in the X-ray diffraction spectrum obtained using CuKα characteristic X-rays as a charge generating material, 10 parts of a vinyl chloride-vinyl acetate copolymer resin (VMCH, manufactured by Nippon Unicar Co., Ltd.) as a binder resin, and 200 parts of n-butyl acetate is dispersed in a sand mill using glass beads having a diameter of 1 milk for 4 hours. 175 parts of n-butyl acetate and 180 parts of methyl ethyl ketone are added to the dispersion liquid thus obtained, and the mixture is stirred. Thus, a coating liquid for charge generating layer is obtained. This coating liquid for charge generating layer is dipping coated on the undercoat layer, and is dried at normal temperature (25° C.). Thus, a charge generating layer having a thickness of 0.2 μm is formed.

(Production of Charge Transport Layer)

33 parts of N,N'-diphenyl-N,N'-bis(3-methylphenyl)-[1,1']biphenyl-4,4'-diamine, 10 parts of T-693 manufactured by Takasago International Corp., and 57 parts of a bisphenol Z polycarbonate resin (viscosity average molecular weight: 50,000) are added to 800 parts of chlorobenzene and dissolved, and thus a coating liquid for charge transport layer is obtained. This coating liquid is applied on the charge generating layer, and is dried for 45 minutes at 135° C. Thus, a charge transport layer having a thickness of 21 μm is obtained.

(Production of Protective Layer)

- Guanamine resin AG-1: 1.5 parts
- Hydroxyl group-containing charge transporting material represented by "I-16": 75 parts
- Alkoxy group-containing charge transporting material represented by "I-27": 23 parts
- Antioxidant 3,5-di-t-butyl-4-hydroxytoluene (BHT): 1.5 parts
- NACURE 2107 (manufactured by King Industries, Inc.): 0.075 part (Catalyst A-1: 5% Based on the Guanamine Resin Ag-1)

- Leveling agent (surfactant BYK-302, manufactured by BYK-Chemie Japan K.K.): 0.05 part
- Cyclopentanol (solvent): 5 parts
- Cyclopentyl methyl ether (solvent): 3 parts The composition as described above is mixed, and thus a coating liquid for protective layer is prepared. This coating liquid is applied on the charge transport layer by a dipping coating method, and is dried in air for 20 minutes at room temperature (25° C.). Subsequently, the dried coating liquid is cured by a heat treatment at 145° C. for 40 minutes to form a protective layer having a thickness of 6.8 μm. Thus, a photoreceptor is produced.

(Measurement of Ionization Potential of Protective Layer)

The coating liquid for protective layer is applied in a single layer on an aluminum base material, and is cured by the same method as described above. Subsequently, the cured film is peeled off, and the film surface is washed with a cloth soaked with methanol. Subsequently, the ionization potentials of the outer surface and the inner surface are measured using AC-2 manufactured by Riken Keiki Co., Ltd. The results of the measurement and the differences between the outer surface and the inner surface are shown in Table 2.

(Measurement of IR Spectrum Showing Indicator of Unreacted Hydroxyl Group of Protective Layer)

The percent transmittance (% T) of the vibration absorption peaks of the hydroxyl group in the protective layer is measured by the method described below. The coating liquid for protective layer is applied in a single layer on an aluminum base material, or on a photosensitive layer laminated on an aluminum base material, and is dried and cured. Subsequently, the cured film thus obtained is used to measure the transmittance in the wavenumber range of 400 $cm^{-1}$ to 4000 $cm^{-1}$ according to an ATR method using FT/IR-6100 manufactured by JASCO Corp. The percent transmittance (% T) for the hydroxyl group is determined such that the offset portion having no absorption is subjected to baseline correction, and the lowest value in the wavenumber region of 3100 $cm^{-1}$ to 3600 $cm^{-1}$ is designated as the transmittance. This transmittance is multiplied by 100 to obtain the percent transmittance value.

[Image Quality Evaluation]

A photoreceptor produced as described above is mounted in a DocuCentre Color 400CP manufactured by Fuji Xerox Co., Ltd., and the following evaluations are sequentially performed under an environment of 10° C. and 15% RH.

A 10% halftone image is subjected to an image forming test of continuously printing 5000 sheets, and the image quality immediately after printing the $5000^{th}$ sheet is subjected to the evaluations described below. Furthermore, after the 5000-sheet image forming test is carried out, the printer is left to stand for 24 hours in an environment of 10° C. and 15% RH, and the initial image quality after the standing is subjected to the evaluations described below.

The results are shown in Table 2.

In the image forming test, P paper (A3 size) manufactured by Fuji Xerox Office Supply Co., Ltd. is used.

(Ghost Evaluation)

Figures 5A, 5B, 5C:
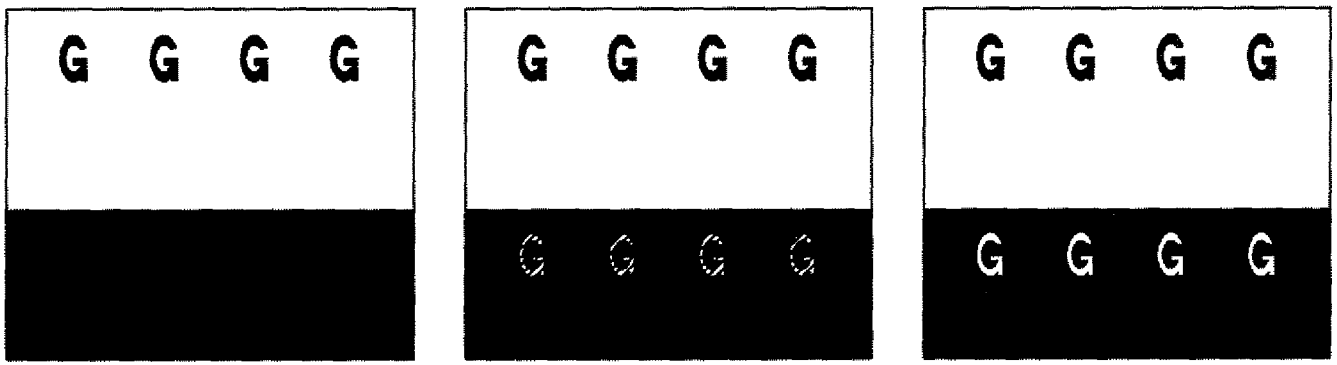

In regard to the ghost phenomenon, a chart of a pattern having letter G and black regions as shown in FIG. 5A is printed, and the state in which the letter G is displayed in the black region is evaluated by visual inspection.

A: Satisfactory or negligible as shown in FIG. 5A

B: Slightly visible as shown in FIG. 5B

C: Clearly recognizable as shown in FIG. 5C (Image Deletion Evaluation)

Image deletion is determined by visual inspection using the same samples used in the ghost evaluation.

A: Good

B: There is no problem immediately after the formation of the $5000^{th}$ image, but image deletion occurs after standing for 24 hours.

C: Image deletion occurs even immediately after the formation of the $5000^{th}$ image.

(Evaluation of Stripes)

The evaluation of stripes is determined by visual inspection using the same samples used in the ghost evaluation.

A: Good

B: There is no problem in the image quality, but stripes slightly occur in some parts.

C: Stripes occur to the extent that causes a problem in the image quality.

[Film Formability Evaluation]

(Evaluation of Wrinkles and Unevenness)

The occurrence of wrinkles and unevenness in the photoreceptor is evaluated as follows by visual inspection and image quality evaluation.

● Evaluation by Visual Inspection

The surface of the photoreceptor produced is observed, and is evaluated as described below.

A: Wrinkles or unevenness is not observed even if the image is magnified 20 times.

B: When the image is magnified 20 times, wrinkles and unevenness are slightly observed.

C: Wrinkles and unevenness are observed even with the naked eye.

● Image Quality Evaluation

A 5% halftone image of magenta color is formed in an environment of 20° C. and 45% RH using a DocuCentre Color 400CP, and an evaluation of the image is carried out.

A: Image unevenness is not observed even if the image is magnified 20 times.

B: When the image is magnified 20 times, image unevenness is slightly observed.

C: Image unevenness is observed even with the naked eye.

Examples 2 to 12 and Comparative Examples 1 to 5

Photoreceptors are produced in the same manner as in Example 1, except that the respective materials, amounts of incorporation and the curing temperature (temperature of heat treatment) used in the production of the protective layer of Example 1 are changed according to Table 1. Evaluations of the photoreceptors are carried out.

TABLE 1

| | Hydroxyl group-containing charge transporting material (A) | Alkoxy group-containing charge transporting material (B) | Ratio of (A) + (B) based on solids content [%] | Resin | Catalyst | Surfactant | Curing temperature [° C.] |
|---|---|---|---|---|---|---|---|
| Example 1 | I-16/75 parts | I-27/23 parts | 96.9% | AG-1/1.5 parts | A-1 | A-1 | 145 |
| Example 2 | I-16/75 parts | I-26/23 parts | 96.9% | AG-1/1.5 parts | A-1 | A-1 | 160 |
| Example 3 | I-5/80 parts | I-33/15 parts | 96.3% | AX-1/2 parts | A-1 | A-1 | 160 |
| Example 4 | I-8/70 parts | I-26/25 parts | 95.4% | AG-1/3 parts | A-1 | A-1 | 155 |
| Example 5 | I-8/73 parts | I-27/20 parts | 97.3% | AG-1/1 part | A-1 | A-1 | 155 |
| Example 6 | I-5/82 parts | I-26/23 parts | 96.7% | AG-1/2 parts | A-1 | A-1 | 165 |
| Example 7 | I-9/98 parts | I-27/23 parts | 97.9% | AG-2/1 part | A-2 | A-2 | 145 |
| Example 8 | I-9/90 parts | I-26/23 parts | 94.5% | AG-2/5 parts | A-3 | A-1 | 145 |
| Example 9 | I-11/95 parts | I-36/15 parts | 96.0% | AX-1/3 parts | A-2 | A-2 | 160 |
| Example 10 | I-3/97 parts | I-26/25 parts | 97.1% | AX-1/2 parts | A-2 | A-2 | 160 |
| Example 11 | I-16/96 parts | I-27/20 parts | 97.0% | AX-1/2 parts | A-3 | A-2 | 150 |
| Example 12 | I-19/91 parts | I-26/23 parts | 95.3% | AG-2/4 parts | A-3 | A-2 | 150 |
| Comp. Ex. 1 | I-16/98 parts | None | 96.9% | AG-1/1.5 parts | A-2 | A-1 | 145 |
| Comp. Ex. 2 | I-5/95 parts | None | 95.4% | AX-1/3 parts | A-2 | A-1 | 160 |
| Comp. Ex. 3 | I-8/91 parts | None | 94.2% | AG-1/4 parts | A-3 | A-1 | 160 |
| Comp. Ex. 4 | None | I-26/91 parts | 96.2% | AG-2/2 parts | A-2 | A-1 | 155 |
| Comp. Ex. 5 | None | I-36/92 parts | 97.3% | AG-1/1 part | A-3 | A-2 | 160 |

* The ratio of (A) + (B) based on the solids content represents the ratio of the total amount of the hydroxyl group-containing charge transporting material (A) and the alkoxy group-containing charge transporting material (B) based on the total solids content.

TABLE 2

| | Ionization potential [eV] | | | Percent transmittance of hydroxyl group in IR analysis | Ghost | | Image | Stripes | | Wrinkles/unevenness (visual inspection/image |
|---|---|---|---|---|---|---|---|---|---|---|
| | Outer | Inner | Difference | [% T] | Immediately after 5000 sheets | After standing for 24 hours | deletion | Immediately after 5000 sheets | After standing for 24 hours | quality) |
| Example 1 | 5.75 | 5.62 | 0.13 | 99.3 | A | A | A | B | B | A/A |
| Example 2 | 5.81 | 5.7 | 0.11 | 98.6 | A | A | A | B | B | A/A |
| Example 3 | 5.75 | 5.56 | 0.19 | 96.5 | A | A | A | B | B | A/A |
| Example 4 | 5.88 | 5.75 | 0.13 | 97.4 | A | A | A | A | A | A/A |
| Example 5 | 5.79 | 5.6 | 0.19 | 98.2 | A | A | A | B | B | A/A |
| Example 6 | 5.81 | 5.7 | 0.11 | 97.7 | A | A | A | A | A | A/A |
| Example 7 | 5.8 | 5.63 | 0.17 | 96.1 | A | A | A | A | A | A/A |
| Example 8 | 5.82 | 5.7 | 0.12 | 95 | A | A | A | A | A | A/A |
| Example 9 | 5.69 | 5.50 | 0.19 | 95.6 | A | A | A | A | A | A/A |
| Example 10 | 5.8 | 5.62 | 0.18 | 99.1 | A | A | A | A | A | A/A |
| Example 11 | 5.71 | 5.53 | 0.18 | 99.2 | A | A | A | A | A | A/A |
| Example 12 | 5.67 | 5.57 | 0.10 | 95 | A | A | A | A | A | A/A |
| Comp. Ex. 1 | 5.7 | 5.68 | 0.02 | 83.4 | C | C | B | B | B | A/B |
| Comp. Ex. 2 | 5.75 | 5.7 | 0.05 | 91.1 | C | C | B | B | B | B/B |
| Comp. Ex. 3 | 5.8 | 5.77 | 0.03 | 93.4 | B | B | C | B | B | B/C |
| Comp. Ex. 4 | 5.8 | 5.75 | 0.05 | 100 | C | C | C | C | C | B/B |
| Comp. Ex. 5 | 5.6 | 5.54 | 0.06 | 99.9 | C | C | B | B | B | B/B |

As shown in the above tables, the ionization potentials of the outer surface of the protective layer are higher by 0.1 eV or more than the inner surface in the Examples, and as compared with the Comparative Examples where the differences are less than 0.1 eV, the outer surfaces of the protective layers are believed to have higher resistance to oxidizing gases such as ozone.

Furthermore, it may be seen that in the Examples where the ionization potential of the inner surface of the protective layer is lower by 0.1 eV or more than the outer surface, defects in the image quality such as the ghost phenomenon or image deletion are suppressed as compared with the Comparative Examples where the differences are less than 0.1 eV.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best exampling the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising a conductive substrate and a photosensitive layer, wherein a layer constituting an outermost surface of the photosensitive layer is a polymerized form of a composition comprising a cross-linkable charge transporting material having a reactive hydroxyl group and a cross-linkable charge transporting material having a reactive alkoxy group, the cross-linkable charge transporting material having a reactive hydroxyl group is a compound represented by the following formula (I-1), and the cross-linkable charge transporting material having a reactive alkoxy group is a compound represented by the following formula (I-2):

$$F^1\text{-}(L^1\text{-}OH)_n \quad \text{(I-1)}$$

$$F^2\text{-}(L^2\text{-}OR)_m \quad \text{(I-2)}$$

where in the formula (I-1) and formula (I-2):

$F^1$ and $F^2$ each independently represent an organic group derived from a compound having hole transportability;

$L^1$ and $L^2$ each independently represent a single bond, or a linear or branched alkylene group having 1 to 5 carbon atoms;

R represents an alkyl group; and n and m each independently represent an integer from 1 to 4; and an ionization potential of an outer surface of the layer constituting the outermost surface of the photosensitive layer is higher by about 0.1 eV or more than the ionization potential of an inner surface of the layer constituting the outermost surface of the photosensitive layer.

2. The electrophotographic photoreceptor of claim 1, wherein the layer constituting the outermost surface of the photosensitive layer is the polymerized form of the composition comprising the cross-linkable charge transporting material having a reactive hydroxyl group and the cross-linkable charge transporting material having a reactive alkoxy group in an amount of about 90% by mass or more based on the total amount of monomers.

3. The electrophotographic photoreceptor of claim 1, wherein the ionization potential of the outer surface of the layer constituting the outermost surface of the photosensitive layer is higher by about 0.3 eV or less than the ionization potential of the inner surface of the layer constituting the outermost surface of the photosensitive layer.

4. The electrophotographic photoreceptor of claim 1, wherein the layer constituting the outermost surface of the photosensitive layer has a percent transmittance (% T) of the stretching vibration peaks of the hydroxyl group of about 95% T or greater as obtained by an infrared absorption spectroscopic analysis.

5. The electrophotographic photoreceptor of claim 1, wherein in the formulas (I-1) and (I-2), the compound having hole transportability for the organic group derived from a compound having hole transportability represented by $F^1$ and $F^2$, is an arylamine derivative.

6. The electrophotographic photoreceptor of claim 1, wherein the compounds represented by the formulas (I-1) and (I-2) are compounds having a structure represented by the following formula (II):

(II)

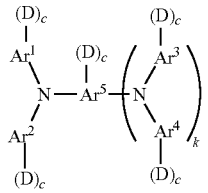

wherein in the formula (II):

$Ar^1$ to $Ar^4$ may be identical or different, and each independently represents a substituted or unsubstituted aryl group;

$Ar^5$ represents a substituted or unsubstituted aryl group or a substituted or unsubstituted arylene group;

D represents $-(L^1\text{-}OH)$ or $-(L^2\text{-}OR)$, where $L^1$ and $L^2$ each independently represent a single bond, or a linear or branched alkylene group having from 1 to 5 carbon atoms, and R represents an alkyl group;

c's each independently represent 0 or 1;

k represents 0 or 1; and the total number of D's is from 1 to 4.

7. The electrophotographic photoreceptor of claim 1, wherein the ionization potential of the outer surface of the layer constituting the outermost surface of the photosensitive layer is higher by 0.15 eV or more than the ionization potential of the inner surface of the layer constituting the outermost surface of the photosensitive layer.

8. An image forming apparatus comprising:

an electrophotographic photoreceptor that has a conductive substrate and a photosensitive layer on the conductive substrate, wherein a layer constituting an outermost surface of the photosensitive layer is a polymerized form of a composition comprising a cross-linkable charge transporting material having a reactive hydroxyl group and a cross-linkable charge transporting material having a reactive alkoxy group, the cross-linkable charge transporting material having a reactive hydroxyl group is a compound represented by the following formula (I-1), and the cross-linkable charge transporting material having a reactive alkoxy group is a compound represented by the following formula (I-2):

$$F^1\text{-}(L^1\text{-}OH)_n \quad \text{(I-1)}$$

$$F^2\text{-}(L^2\text{-}OR)_m \quad \text{(I-2)}$$

where in the formula (I-1) and formula (I-2):

$F^1$ and $F^2$ each independently represent an organic group derived from a compound having hole transportability;

$L^1$ and $L^2$ each independently represent a single bond, or a linear or branched alkylene group having 1 to 5 carbon atoms;

R represents an alkyl group; and n and m each independently represent an integer from 1 to 4; and an ionization potential of an outer surface of the layer constituting the outermost surface of the photosensitive layer is higher by about 0.1 eV or more than an ionization potential of an inner surface of the layer constituting the outermost surface of the photosensitive layer;

a charging device that charges the surface of the electrophotographic photoreceptor;

an exposure device that exposes the surface of the charged electrophotographic photoreceptor to form an electrostatic latent image on the surface of the charged electrophotographic photoreceptor;

a developing device that develops the electrostatic latent image with a developer to form a toner image; and a transfer device that transfers the toner image to a medium to be transferred.

9. The image forming apparatus of claim 8, wherein the layer constituting the outermost surface of the photosensitive layer is the polymerized form of the composition comprising the cross-linkable charge transporting material having a reactive hydroxyl group and the cross-linkable charge transporting material having a reactive alkoxy group in an amount of about 90% by mass or more based on the total amount of monomers.

10. The image forming apparatus of claim 8, wherein the ionization potential of the outer surface of the layer constituting the outermost surface of the photosensitive layer is higher by about 0.3 eV or less than the ionization potential of the inner surface of the layer constituting the outermost surface of the photosensitive layer.

11. The image forming apparatus of claim 8, wherein the layer constituting the outermost surface of the photosensitive layer has a percent transmittance (% T) of stretching vibration peaks of a hydroxyl group of about 95% T or greater as obtained by an infrared absorption spectroscopic analysis.

12. A process cartridge that is detachable from an image forming apparatus, the process cartridge comprising:

an electrophotographic photoreceptor that includes a conductive substrate and a photosensitive layer on the conductive substrate, wherein a layer constituting an outermost surface of the photosensitive layer is a polymerized form of a composition comprising a cross-linkable charge transporting material having a reactive hydroxyl group and a cross-linkable charge transporting material having a reactive alkoxy group, the cross-linkable charge transporting material having a reactive hydroxyl group is a compound represented by the following formula (I-1), and the cross-linkable charge transporting material having a reactive alkoxy group is a compound represented by the following formula (I-2):

$$F^1\text{-}(L^1\text{-}OH)_n \quad \text{(I-1)}$$

$$F^2\text{-}(L^2\text{-}OR)_m \quad \text{(I-2)}$$

where in the formula (I-1) and formula (I-2):

$F^1$ and $F^2$ each independently represent an organic group derived from a compound having hole transportability;

$L^1$ and $L^2$ each independently represent a single bond, or a linear or branched alkylene group having 1 to 5 carbon atoms;

R represents an alkyl group; and n and m each independently represent an integer from 1 to 4; and an ionization potential of an outer surface of the layer constituting the outermost surface of the photosensitive layer is higher by about 0.1 eV or more than an ionization potential of an inner surface of the layer constituting the outermost surface of the photosensitive layer; and at least one selected from the group consisting of a charging device that charges the surface of the electrophotographic photoreceptor, an exposure device that exposes the surface of the charged electrophotographic photoreceptor to form an electrostatic latent image on the surface, a developing device that develops the electrostatic latent image with a developer to form a toner image, and a cleaning device that removes any residual toner remaining on the surface of the electrophotographic photoreceptor.

13. The process cartridge of claim 12, wherein the layer constituting the outermost surface of the photosensitive layer is the polymerized form of the composition comprising the cross-linkable charge transporting material having a reactive hydroxyl group and the cross-linkable charge transporting material having a reactive alkoxy group in an amount of about 90% by mass or more based on the total amount of monomers.

14. The process cartridge of claim 12, wherein the ionization potential of the outer surface of the layer constituting the outermost surface of the photosensitive layer is higher by about 0.3 eV or less than the ionization potential of the inner surface of the layer constituting the outermost surface of the photosensitive layer.

15. The process cartridge of claim 12, wherein the layer constituting the outermost surface of the photosensitive layer has a percent transmittance (% T) of stretching vibration peaks of a hydroxyl group of about 95% T or greater as obtained by an infrared absorption spectroscopic analysis.

* * * * *